US005801737A

United States Patent [19]

Sato et al.

[11] Patent Number: 5,801,737

[45] Date of Patent: Sep. 1, 1998

[54] INK CONTAINER WITH INTERNAL AIR PRESSURE ADJUSTMENT

[75] Inventors: Yohei Sato, Yokohama; Kazuaki Masuda, Kawasaki; Torachika Osada, Yamato; Masahiko Higuma, Tohgane; Jun Kawai, Tokyo; Masaaki Izumida, Kawasaki; Yoichi Taneya, Yokohama; Masaru Iketani, Zama, all of Japan

[73] Assignee: Canon Kabushiki Kaisha, Tokyo, Japan

[21] Appl. No.: 797,042

[22] Filed: Feb. 10, 1997

Related U.S. Application Data

[62] Division of Ser. No. 488,315, May 23, 1995, abandoned.

[30] Foreign Application Priority Data

May 25, 1994 [JP] Japan ..... 6-111026
Jan. 13, 1995 [JP] Japan ..... 7-004264

[51] Int. Cl.[6] ..... B41J 2/175

[52] U.S. Cl. ..... 347/86

[58] Field of Search ..... 397/85, 86, 87, 397/89, 92, 17

[56] References Cited

U.S. PATENT DOCUMENTS

| | | | |
|---|---|---|---|
| 3,873,218 | 3/1975 | Yoshida | 401/292 |
| 4,301,459 | 11/1981 | Isayama et al. | 347/92 |
| 4,383,263 | 5/1983 | Ozawa et al. | 347/30 |
| 4,509,062 | 4/1985 | Low et al. . | |
| 4,571,599 | 2/1986 | Rezanka . | |
| 4,771,295 | 9/1988 | Baker et al. . | |
| 4,968,998 | 11/1990 | Allen . | |
| 4,992,802 | 2/1991 | Dion et al. . | |
| 5,025,271 | 6/1991 | Baker et al. . | |
| 5,216,450 | 6/1993 | Koitabashi et al. . | |
| 5,289,212 | 2/1994 | Carotta . | |
| 5,430,471 | 7/1995 | Nakajima et al. | 347/87 |
| 5,448,400 | 9/1995 | Crystal et al. | 347/85 |
| 5,557,305 | 9/1996 | Hine et al. | 347/17 |

FOREIGN PATENT DOCUMENTS

| | | | |
|---|---|---|---|
| 0493058 | 7/1992 | European Pat. Off. | B41J 2/175 |
| 0529880 | 3/1993 | European Pat. Off. . | |
| 0560729 | 9/1993 | European Pat. Off. | B41J 2/175 |
| 0562717 | 9/1993 | European Pat. Off. | B41J 2/175 |
| 0567270 | 10/1993 | European Pat. Off. | B41J 2/175 |
| 581531 | 2/1994 | European Pat. Off. . | |
| 3640-032-A | 5/1988 | Germany | 347/87 |
| 55-65560 | 5/1980 | Japan | B41J 3/04 |
| 63-265643 A | 11/1988 | Japan | 347/85 |
| 5-162326 | 6/1993 | Japan | 347/86 |
| 6-15838 | 1/1994 | Japan | 347/86 |

*Primary Examiner*—N. Le
*Assistant Examiner*—Judy Nguyen
*Attorney, Agent, or Firm*—Fitzpatrick, Cella, Harper & Scinto

[57] ABSTRACT

An ink container includes an ink storing portion for storing ink; an ink supplying portion for supplying ink to a recording head portion; an air vent for taking the atmospheric air into the ink container; and a hollow tube, one end of which opens to the atmosphere at the air vent, above the liquid level of the stored ink, and the other end of which opens within the ink container adjacent to the bottom portion of the ink container.

12 Claims, 21 Drawing Sheets

INK CONTAINER WITH INTERNAL AIR PRESSURE ADJUSTMENT

This application is a division of application Ser. No. 08/448,315 filed May 23, 1995, now abandoned.

FIELD OF THE INVENTION AND RELATED ART

The present invention relates to an ink container for storing the ink to be supplied to a recording head, and an ink jet recording apparatus that takes such an ink container in order to record (print) images (including characters) on recording medium.

There are various structures for supplying the ink to the recording head of an ink jet recording apparatus: a structure in which the ink is supplied from a replaceable ink container mounted within the apparatus to a recording head mounted fixedly on a carriage, through a tube routed within the apparatus; a structure in which the ink container and recording head are integrated into a combination cartridge, which is replaceably mounted on the carriage; and the like.

In the former structure, the ink is delivered by generating a difference in ink head pressure between the ink container and recording head, and in the latter structure, the ink is delivered with the provision of a negative pressure generating source on the ink container side.

In recent years, a large number of apparatuses employing an ink container with the latter structure have been proposed from the standpoint of downsizing and ease of maintenance.

Such an ink container is required not only to be capable of supplying preferably the ink to the recording head in proportion to the amount of the ink ejected from the recording head during a recording operation, but also, not to allow the ink to leak from the ejection orifice during a non-recording period.

As examples of such an ink container, those disclosed in U.S. Pat. Nos. 4,771,295 and 5,025,271 have been known. In these examples, the recording head and ink container are united into a cartridge, which is removably mountable on the carriage, and the ink container is filled with a piece of foamed material (absorbent material). By filling the ink container with the absorbent material, a stable ink meniscus can be maintained at the ink ejecting portion of the recording head, and the ink is retained within the ink container because of the capillary force of this absorbent material. In this case, it is necessary that substantially the entire space within the ink container is filled with the absorbent material, and the ink is filled in the ink container by an amount slightly less than the maximum amount retainable by the absorbent material. This arrangement generates a negative pressure within the ink container due to the capillary force; therefore, even when the ink container is subjected to mechanical impacts such as vibration and/or thermal shocks such as temperature changes, the ink leak from the ink ejecting portion or an air venting portion of the recording head can be kept to the minimum, making it possible to reliably retain the ink.

However, in the case of the system in which the entire internal space of the ink container is filled with the absorbent material, the negative pressure generated by the absorbent material increases as the ink is consumed. As a result, the amount of the ink left unused within the ink container is liable to increase. In other words, there is a problem of poor ink usage efficiency.

As for the absorbent material to be placed within this type of ink container, foamed urethane resin, for example, is available. In the case of the foamed urethane material, it is liable that film is formed within the material in a manner of wrapping the bores during its production, and when a large number of bores are separated from each other by the film, there is no way that the foamed urethane can serve as the absorbent material, unless its properties are modified; therefore, the film is removed by heating, cleaning, or the like.

When the foamed urethane material having been treated as described in the foregoing is used as the internal absorbent material for the ink container, it is compressed into the ink storing space of the ink container, or in some cases, only the portion placed within the ink tapping joint between a connecting member and the ink container is compressed. However, even when the material is subjected to the film removing treatment such as described above, it is extremely difficult to remove completely the film; in other words, in reality, there is going to remain a substantial amount of residual film adhering to the bores. Therefore, when the absorbent material is compressed, the residual film of the adjacent bores collaboratively react to interfere with the ink flow that is to be generated within the absorbent material in response to the ink consumption. As a result, the outward ink flow from within the ink container is impeded.

Further, when the foamed resin material such as the foamed urethane is left immersed in the ink for a long period, it is liable that the foamed material components are dissolved into the ink, whereby the foamed material itself is deteriorated or the ink properties are changed. This also prevents the ink from being stably supplied to the recording head, which in turn deteriorates the quality of the print.

In addition, the overall ink retaining force of the ink container containing the foamed material such as these described above is generated as the sum of the ink meniscus forces of all the bores of the foam material; therefore, the amount of the ink retainable is naturally limited. According to our observations, the volume of the retainable ink amounts to only 50% to 70% of the internal volume of the ink container, and when the ink is filled beyond this limit, a substantial amount of the ink must be extracted from within the ink container in order to generate a proper amount of the negative pressure. This involves a manufacture related problem to be eliminated.

As one example of the structures for solving the aforementioned various problems of the ink container containing the absorbent material, a certain ink container structure can be mentioned, its technical principle of which is disclosed in the U.S. Pat. No. 4,509,062, and its specific embodiments of which are disclosed in the U.S. Pat. No. 4,992,802.

In particular, according to the general structure of the ink container disclosed in the U.S. Pat. No. 4,992,802, the absorbent material is not filled in the ink container, and the liquid ink is directly filled within the ink container as illustrated in FIGS. 1, 2(A) and 2(B). More specifically, as shown in FIGS. 1, 2(A) and 2(B), an ink jet printing head unit 110 comprising an ink storage 112 and a printing head 130 further comprises an orifice 136 as the first pressure regulating means, in a part of a cylinder 128 connecting them, for regulating the negative pressure of the ink storage 112, and a pouch 126 as the second pressure regulating means for regulating the negative pressure of the ink storage 112 as it changes its volume. The ink jet printing head unit 110 further comprises: an opening 142, as an ink filling port, which is located in the top wall; a plug 144, which is pushed into the opening 142 to seal it; an overflow storage 138 for storing the ink overflowing outward from the orifice 136;

and a vent 140, through which the overflow storage 138 is in communication with the ambient air.

With this structure, as the ink is ejected from the printing head 130, that is, as the ink is consumed from the ink storage 112, the internal pressure of the ink storage 112 is continuously reduced while the meniscus formed at the orifice 136 holds. As a result, a preferable negative pressure can be maintained at the printing head 130. As the ink ejection further continues, the negative pressure of the ink storage 112 is further increased. When the negative pressure value exceeds a threshold value, the meniscus at the orifice 136 breaks, which allows the air to be introduced into the ink storage 112, putting thereby the negative pressure back into a preferable negative pressure range. This action is repeated to allow the ink to be preferably ejected.

The measurement of the change in the negative pressure of an ink container provided with only the orifice 136 as the first negative pressure regulating means illustrated in FIG. 2 reveals that such a negative pressure as indicated by a solid line A in FIG. 3 is generated at the printing head 130. In other words, an excessive negative force (peak value) was generated in the printing head 130 right after the ink use began. When the negative pressure has a value close to this peak value, the amount of the ink supplied to the printing head 136 becomes insufficient, which in turn causes the ink ejection to be unstable, resulting in the dim print.

Further, it depends on the diameter of the orifice 136, but the ink within the ink storage 112 is liable to leak out of the orifice 136 due to the weight of the ink itself, preventing the negative pressure generation. According to our experiment, in which the internal diameter of the orifice was 0.38 mm, and three different inks with the surface tension of 30 dyne/cm, 40 dyne/cm, and 50 dyne/cm were involved, the ink began to leak from the orifice when the ink level from printing head 130 was increased to 40 mm.

When the diameter of the orifice 136 is decreased to prevent the ink leak (2 mm or less, for example: such a decrease further increases the peak value), the generation of the negative pressure close to the peak value can be prevented by providing a pouch 126 within the ink storage 112. In this case, the pouch 126 is made of self-restorative material so that it restores itself in such a manner as to increase the volume of the ink storage 112, or is provided with a spring so that it is pressed in the same manner. Therefore, the generation of the initial negative peak is eliminated by this pouch 126, and as a result, the negative pressure changes, as indicated by a broken line in FIG. 3, are displayed.

However, in the case of the ink container with such a structure, the diameter of the orifice 136 and the self-restorative force of the pouch 126 must be determined according to the ink to be used, which increases the component count, complicates the ink container structure, and as a result, is liable to increase the cost. Further, the generated negative pressure has a tendency to vary depending on the amount of the ink remaining in the ink container (in particular, this is liable to occur in the case of the structure disclosed in U.S. Pat. No. 4,509,062); therefore, it is liable to become impossible to stably supply the ink.

SUMMARY OF THE INVENTION

A primary object of the present invention is to solve the aforementioned various problems, and thereby, to provide a highly reliable ink container with an improved ink usage efficiency, which employs a simple structure to maintain the stable negative pressure, and thereby, to provide high quality print, and an ink jet recording apparatus usable with such an ink container.

The inventors of the present invention spent a great amount of time and effort to achieve the object described in the foregoing, and as a result, discovered that the structure of the portion, at which the meniscus is formed, is the cause of the negative pressure surge.

The present invention was made based on the discovery mentioned above, and its primary object is to provide an ink container comprising: an ink storing portion for storing the ink, an ink supplying portion for supplying ink to a recording head portion, and an air vent for taking the atmospheric air into the ink container, comprising further a fine hollow tube, one end of which opens to the atmosphere at the air vent, above the liquid level of the stored ink, and the other end of which opens within the ink container adjacent to the bottom portion of the ink container, wherein an air permeable film is disposed at the air vent, and the air permeable film has water repellency at least on the surface facing inward of the ink container.

Another object of the present invention is to provide an ink container, which comprises a connecting portion disposed at the bottom thereof for making connection with a recording head, and stores liquid ink, while maintaining above the liquid ink, an air layer sealed from the atmosphere, comprising further pressure reducing means capable of reducing the pressure of the air layer below the atmospheric pressure without consuming the ink within the ink container.

Another object of the present invention is to provide an ink jet recording apparatus, in which an ink container, which comprises a connecting portion disposed at the bottom thereof for making connection with a recording head, and stores liquid ink, while maintaining above the liquid ink, an air layer sealed from the atmosphere, and pressure reducing means capable of reducing the pressure of the air layer below the atmospheric pressure without consuming the ink within said ink container, is installed, further comprising activating means for activating the pressure reducing means with a predetermined timing.

According to the structure described above, as the ink within the ink container is consumed, the air intermittently enters the ink container through the opening of the ink container. At this time, the negative pressure force, which works to pull the ink inward the ink container, is generated at the ink supplying portion or the ink ejecting opening of the recording head, due to the pressure reduction in the air pocket formed in the ink container by the air which enters as the ink is consumed. Therefore, a proper amount of the negative pressure force is maintained at the recording head portion to stably supply the ink, and thereby, offer preferable print quality.

Further, this negative pressure remains even after the ink consumption is interrupted, functioning thereby to prevent the ink leak from the recording head portion.

Further, the air permeable film prevents the ink from flowing out of the air vent during the transportation or the like of the ink container.

According to a further aspect of the present invention, the ink container comprises means for moderating the increase in the internal pressure of the ink container, so that the increase or decrease in the air pocket volume triggered by the ambience change can be satisfactorily dealt with. Therefore, the negative pressure within the ink container can be preferably maintained, without ever increasing to the positive side.

Further, the ink container comprises means capable of reducing the air layer pressure below the atmospheric pressure without consuming the ink within the ink container.

Therefore, when the ink container is installed in an ink jet recording apparatus, the pressure of the air layer can be maintained to be negative by carrying out a pressure reducing operation, without consuming the ink.

As the ink within the ink container is consumed, the air intermittently enters the ink container through the opening of the connecting member. At this time, the ink container generates at the connecting member for the recording head, and subsequently, at the ink ejecting orifice of the recording head, a negative pressure, which works in the direction of pulling the ink into the ink container, in proportion to the amount of the negative pressure generated in the air layer through the ink consumption and the meniscus force at the opening. Therefore, a proper amount of the negative pressure is generated at the recording head to stably supply the ink, and thereby, to offer the preferable print quality. Further, this negative pressure remains even after the ink consumption ceases, preventing thereby the ink leak from the recording head. On the other hand, when the ink container is installed for the first time after it is transported, there are times when the ink level within the connecting member and the ink level within the ink container have substantially equalized. In this state, no negative pressure is generated. In this case, however, the air is discharged from the air layer into the atmosphere through a one-way valve to reduce the pressure of the air layer, whereby and in conjunction with the meniscus formed at the opening, the negative pressure force as described above can be generated.

Further, when means for increasing the pressure of the air layer is activated, a portion of the pressurized air is discharged out of the ink container through the one-way valve, and after the pressurization stops, the one-way valve closes and prevents the air from flowing in from the outside; therefore, a predetermined amount of the negative pressure is maintained within the air layer.

Further, when the ink container is installed in the ink jet recording apparatus, the outward one-way valve for sealing the air layer is opened to discharge the air outward the ink container from the air layer, and then, the valve is closed, whereby the pressure of the air layer is reduced to generate the negative pressure force.

Further, since an air permeable film having a water repellent surface at least on the side facing the liquid is provided, the ink leak resulting from the splashed ink or the like can be prevented.

Further, activating means is operated with a predetermined timing to reduce the pressure of the air layer within the mounted ink container, whereby the negative pressure can be generated at the recording head at a predetermined timing.

Further, the air of the air layer within the mounted ink container is sucked by sucking means through the one-way valve, whereby the pressure of the air layer is reduced.

Further, the air of the air layer within the mounted ink container is sucked by the sucking means through the valve opened by valve opening means, whereby the pressure of the air layer is reduced.

Further, power is supplied to the heater of the mounted ink container by power supplying means to expand thermally the air of the air layer, so that the portion thereof is discharged out of the ink container through the one-way valve, and then, the power supply is stopped, whereby the pressure of the air layer is reduced due to the thermal contraction.

Further, the pump of the mounted ink container is driven by driving means to increase the pressure of the air layer, so that the portion thereof is discharged out of the ink container through the one-way valve, whereby the air layer pressure is reduced as the piston returns to the home position after the driving stops.

In the structure in accordance with the present invention, a meniscus M is formed at an opening 5 (hole 5) provided at the tip of the fine hollow tube 4. The behavior of this meniscus M is shown in FIGS. 4(*a*) and 4(*b*), wherein FIG. 4(*a*) depicts the condition thereof right after the beginning of the ink ejection, and the meniscus M is formed inward the fine tube 4.

As the ink is consumed, the surface of the ink (meniscus M) within the fine tube 4 reaches a point depicted in FIG. 4(*b*), that is, as far as it can reach into the ink from the opening 5, without self destruction. Then, as the ink is further consumed, and thereby, the pressure of the air pocket 8 within the ink container is increased, the meniscus M is broken, allowing thereby the atmospheric air to enter the ink container, whereby the negative pressure within the ink container is restored to and maintained in a predetermined range, in other words, is prevented from being reduced to an extreme low level.

In comparison to the above, the behavior of the meniscus M formed at the orifice 136 of the ink container in accordance with the U.S. Pat. No. 4,992,802 mentioned with regard to the prior art is shown in FIGS. 5(*a*) and 5(*b*). In the case of this structure, the meniscus is formed at two points, a top portion 136*b* or a bottom portion 136*a*, of a member constituting the orifice 136. As shown in FIG. 5, the meniscus M is formed at the bottom portion 136*a* of the orifice 136 at the beginning of the ink consumption, and is formed at the top portion 136*b* of the orifice 136 toward the end of the ink consumption. When the meniscus M is formed at two points, the top or bottom, as described above, peaks appear in the value of the negative pressure within the ink container.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment (Embodiment 1)

Hereinafter, the embodiments of the present invention will be described with reference to the drawings.

Figure 1:
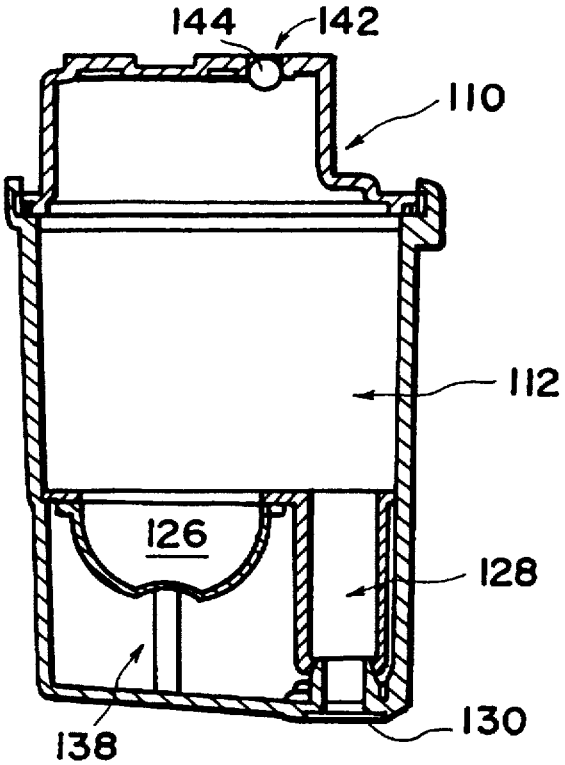
FIG. 1 PRIOR ART
FIG. 1 is a schematic sectional view of an example of the ink container which serves as the technical background for the present invention.
Figure 2A:
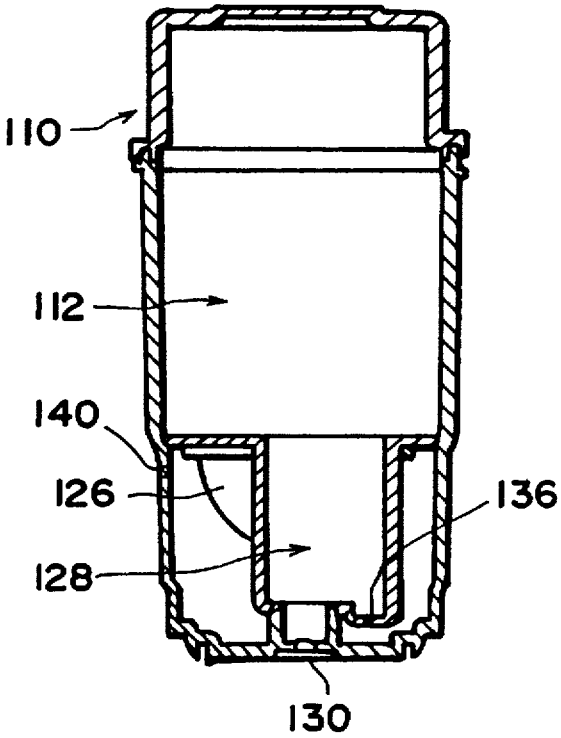
FIG. 2A PRIOR ART
FIG. 2(A) is a sectional view of the ink container illustrated in FIG. 1, as seen from a different direction.
Figure 2B:
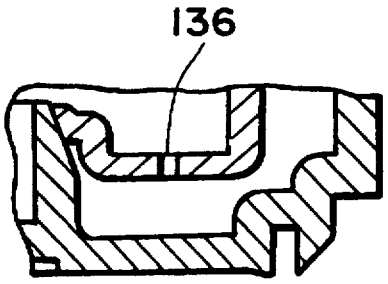
FIG. 2B PRIOR ART
FIG. 2(B) is a partially enlarged sectional view thereof.
Figure 3:
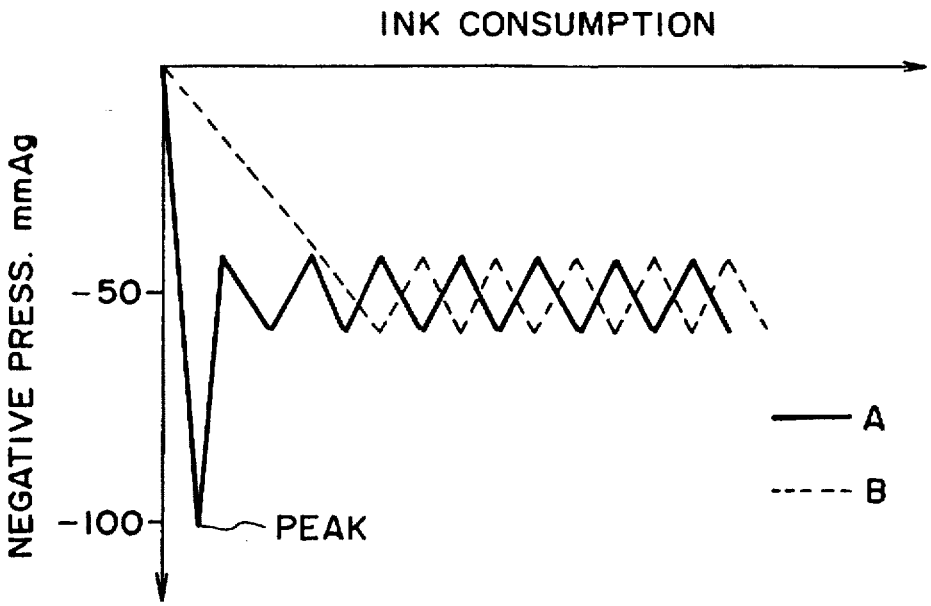
FIG. 3 PRIOR ART
FIG. 3 is a graph showing the relationship between the negative pressure generated by the ink container serving as the technical background, and the ink consumption of the same ink container.
Figure 4A:
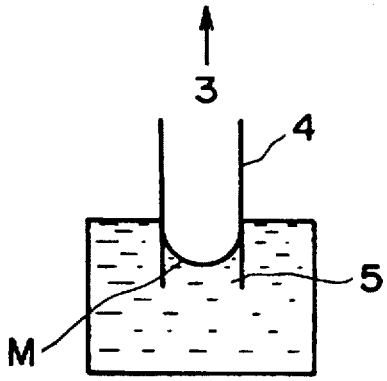
FIGS. 4(*a*) and 4(*b*) are schematic views of the meniscus formed at the opening of the fine tube disposed in the ink container according to the present invention.
Figure 4B:
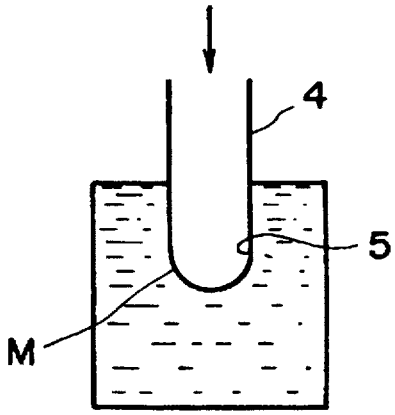
Figure 5A:
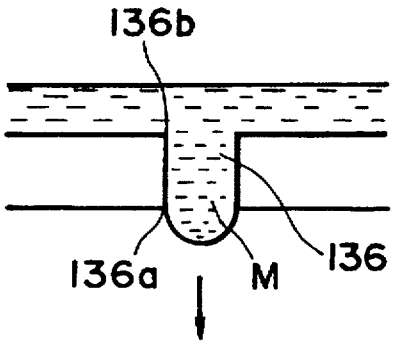
FIG. 5A PRIOR ART
FIGS. 5(*a*), 5(*b*) and 5(*c*) are schematic views of the various states of the meniscus formed within the ink container illustrated in FIG. 1.
Figure 5B:
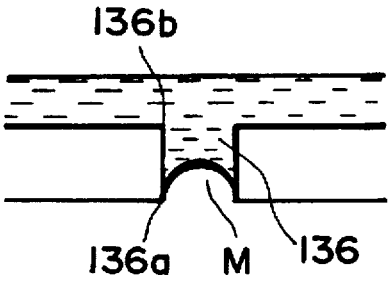
FIG. 5B PRIOR ART
Figure 5C:
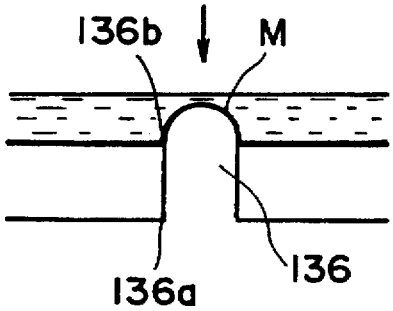
FIG. 5C PRIOR ART
Figure 6:
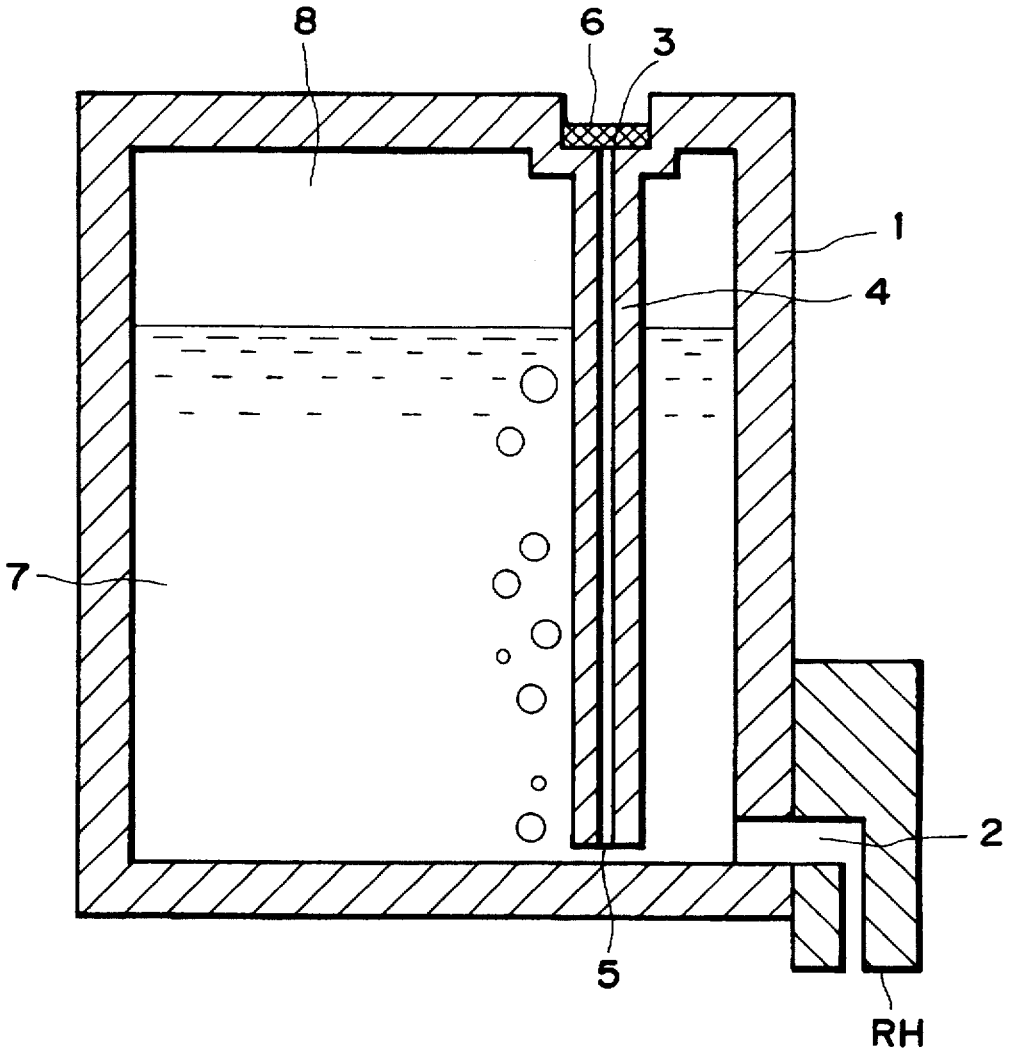
FIG. 6 is a schematic sectional view of a preferable embodiment of ink container according to the present invention.

FIG. 6 is a sectional view of the structure of the first embodiment of the present invention.

An ink container 1 comprises an ink supplying portion 2 that supplies the ink to a recording head portion RH, and an air vent 3 through which the atmospheric air is allowed to enter the ink container 1. The ink container 1 is sealed from the atmospheric air except for these openings. A fine tube 4 is hollow, one end of which is in communication with the air vent 3, being open to the atmospheric air, above the liquid level of the stored ink, and the other end of which is open as a hole within the ink container, near the bottom of the ink container 1. Across the air vent 3, an air permeable film 6 is disposed, the inward facing surface of which is water repellent.

According to the above structure, the air intermittently enters the ink container 1 through the hole 5, in response to the consumption of an ink 7. At this time, the ink container generates a negative pressure force in the direction to draw the ink 7 inwards of the ink container 1, at the ink ejecting orifice of the recording head RH, due to the pressure drop caused by the ink consumption and the strength of the meniscus force of the air in the hole 5. As a result, a proper degree of negative pressure is provided in the recording portion to supply stably the ink, and thereby, to offer preferable print quality.

Further, even after the ink consumption is interrupted, this negative pressure force remains and prevents the ink leak from the recording head portion RH.

The air permeable film 6 is provided for preventing the ink from spilling out of the air vent 3 due to the vibration or the like while the ink container is transported.

The negative pressure was measured at the ink supplying portion 2, using an ink container 1 comprising a fine polypropylene tube 4 with an internal diameter of 0.38 mm at the hole 5, and an ink with a surface tension of 48 dyne/cm. The ink holding negative pressure force during the printing operation and standby operation were substantially −48 $mmH_2O$ and −42 $mmH_2O$, respectively. The negative pressure force measured using the same system and different inks having different composition and surface tension (surface tension of 30 dyne/cm, and 40 dyne/cm) is given in Table 1.

TABLE 1

| | Ink (1) | Ink (2) | Ink (3) |
|---|---|---|---|
| Surface tension (dyne/cm) | 30 | 40 | 48 |
| Negative pressure during printing (mmAg) | −33 | −38 | −48 |
| Retained negative pressure in static state (mmAg) | −25 | −32 | −42 |

When the ink of a different composition is used, substantially the same level of negative pressure can be obtained by changing the internal diameter of the hole 5 and the material therefor. For example, when the surface tension of the ink is smaller, the diameter of the hole 5 is changed in the reducing direction.

According to experiments, the negative pressure force was not affected by the ink level, and displayed a substantially constant value from the beginning of the ink consumption right up to a point when the ink is depleted. Further, it did not display an excessive negative value at the beginning of the ink consumption. This means that this embodiment can offer substantially stable print quality from the beginning of the ink consumption right up to the moment of the ink depletion.

Further, even when the ink enters the fine tube 4 during the transportation, the negative pressure can be generated as soon as the ink within the fine tube 4 is completely sucked out by a pressure restoring pump during the installation of the ink container (in this embodiment, in which the internal volume of the fine tube is 0.9 cc, the ink within the fine tube 4 can be surely and completely discharged by setting the pump capacity at 1.3 cc).

As for the air permeable film of this embodiment, its material is polytetrafluoroethylene, wherein this material is stretched to create numerous microscopic pores, and then, is given an oil repelling treatment. The diameter of the microscopic pore is 0.1–3.0 μm.

Figure 8A:
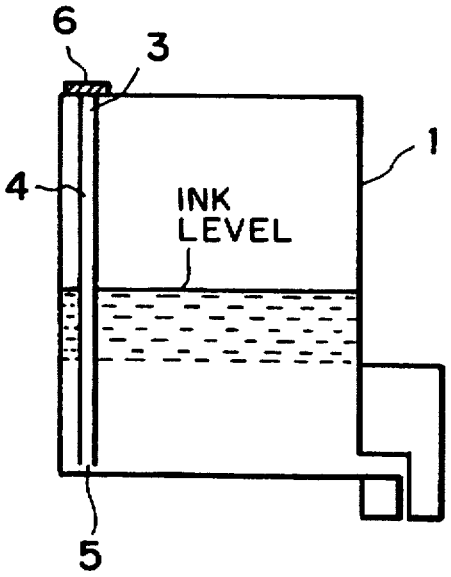
FIGS. 8(*a*) and 8(*b*) are schematic sectional views of the ink container in accordance with the present invention, depicting the orientation thereof.
Figure 8B:
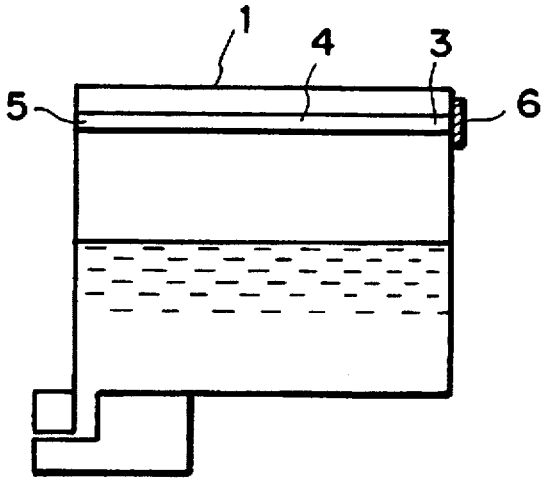
Figure 9A:
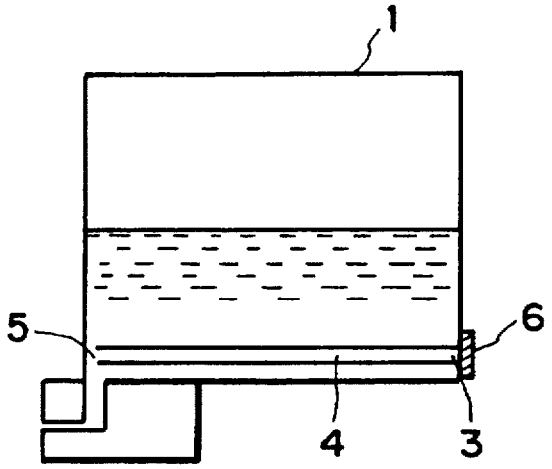
FIGS. 9(*a*)and 9(*b*) are schematic sectional views of the ink container in accordance with the present invention, depicting the positioning of the fine tube.
Figure 9B:
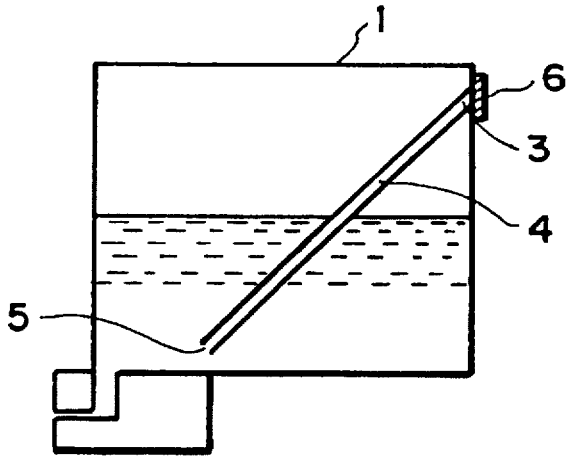

As for the positional relationship between the ink supplying portion 2 and the hole 5 of the fine tube 4, it is preferable that the hole 5 opens adjacent to the ink supplying portion 2 as shown in FIGS. 6 and 9(*a*). The reason for this preference is that this arrangement allows the meniscus to be effectively formed even when the ink container is nonuprightly oriented as shown in FIG. 8(*b*) or FIG. 9(*a*). With the relationship as shown in FIG. 8(*a*), when the ink container is oriented so that the ink supplying portion 2 comes to the bottom and the hole 5 goes to the top, the air pocket 8 within the ink container 1 is placed in direct communication with the atmospheric air through the hole 5; therefore, if the ink ejecting orifice (it is normally of such a size that the meniscus force does not allow the ink to leak), for example, if the head portion comes in contact with a sheet of paper or the like, and thereby, the meniscus at the orifice is broken, the ink leaks from the ejection orifice of the head portion. However, with the hole 5 and ink supplying portion 2 being positioned as indicated in FIG. 6 or FIG. 9(*a*), even when the ink container is nonupright as shown in FIG. 9, and the meniscus at the ejecting orifice is broken, the atmospheric air is not supplied to the air pocket 8; therefore, the ink does not leak out of the ejection orifice. Needless to say, in case the recording head orientation is such that the recording head ejects the ink downward as shown in FIG. 6 or FIG. 8(*a*), the positional relationship between the ink supplying opening 2 and the hole 5 of the fine tube 4 does not necessarily have to be limited to the one described above. For example, a positional relationship such as the one shown in FIG. 9(*b*) is capable of dealing with both the upright and horizontal orientations.

(Embodiment 2)

Figure 10:
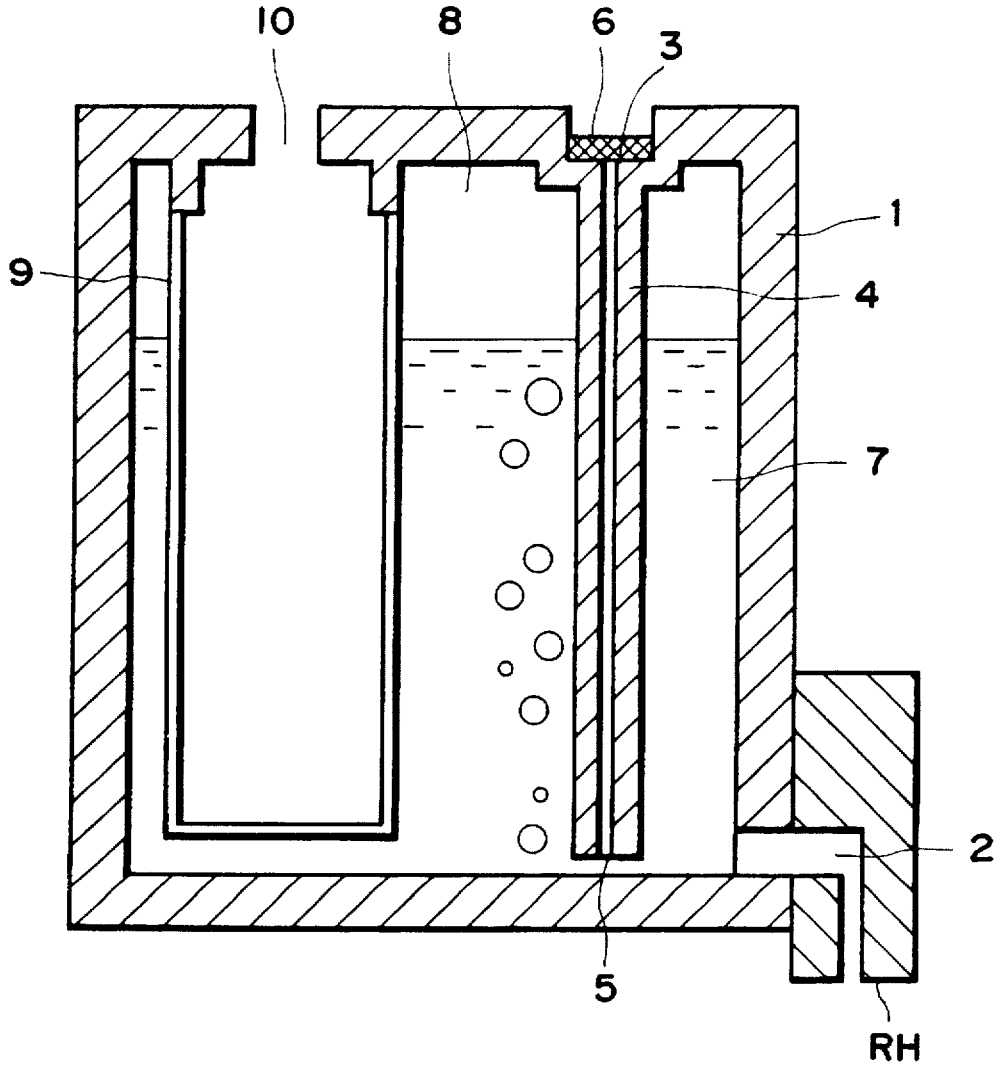
FIG. 10 is a schematic sectional view of another embodiment of the ink container according to the present invention.

FIG. 10 is a sectional view of the second embodiment of the present invention.

The second embodiment is similar to the first one with regard to the principle for generating the negative pressure force at the recording head portion, but is different in that in order to further improve the reliability, a flexible pouch 9 is provided within the ink container 1, as means for moderating the internal pressure increase. The pouch 9 is in communication with the atmospheric air through the opening 10, being otherwise sealed. It is so designed that the pouch 9 displays its maximum volume at the beginning of the ink consumption, and does not expand even when the internal pressure of the ink container is reduced relative to the atmosphere; therefore, it does not affect the negative pressure force at the recording head portion. On the other hand, when the environment surrounding the ink container 1 changes, for example, when the ink container is placed in a low pressure environment during the transportation or the like, or when the ambient temperature increases due to the internal heat radiation of the printer, or the like, a volume equivalent to the expansion of the air pocket 8 is absorbed by the volumetric contraction of the pouch 9 to moderate the increase in the internal pressure of the ink container, preventing thereby the ink from leaking out of the recording head portion. Then, as the environment is restored to its original state, the volume of the pouch 9 restores its original volume, that is, the maximum volume, and thereafter, does not affect the negative pressure force at the recording head portion.

Further, there may be chances that during the transportation (it is conceivable that the environmental change may be considerably severe), the air may be forced into the ink container 1 through the fine tube 4 by impacts such as vibration, which may prevent the pouch 9 from holding the maximum volume at the beginning of the ink consumption; therefore, it is preferable that the air vent 3 and the opening above the air permeably film 6 be kept sealed with tape or the like during the transportation, that is, until the ink container 1 is installed in the printer.

(Embodiment 3)

Figure 11:
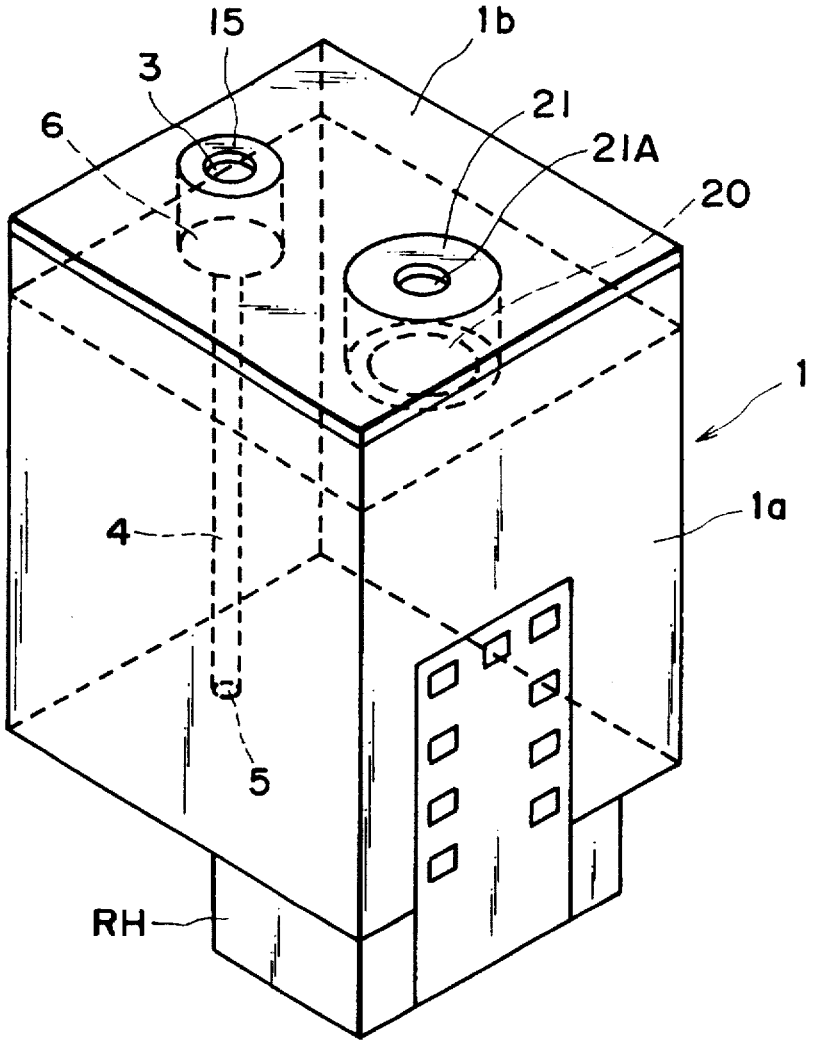
FIG. 11 is a schematic perspective view of another embodiment of the ink container according to the present invention.
Figure 12:
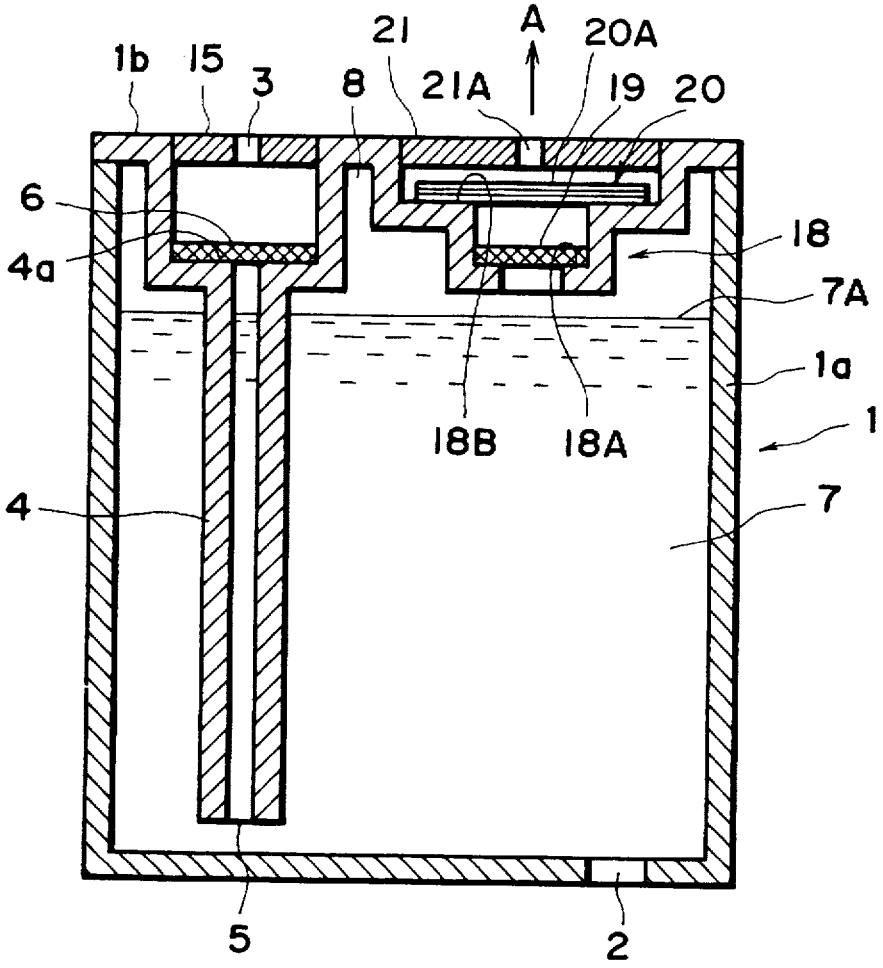
FIG. 12 is a schematic sectional view of the ink container illustrated in FIG. 11, depicting the state thereof, in which the ink container has not been negatively pressurized.
Figure 13:
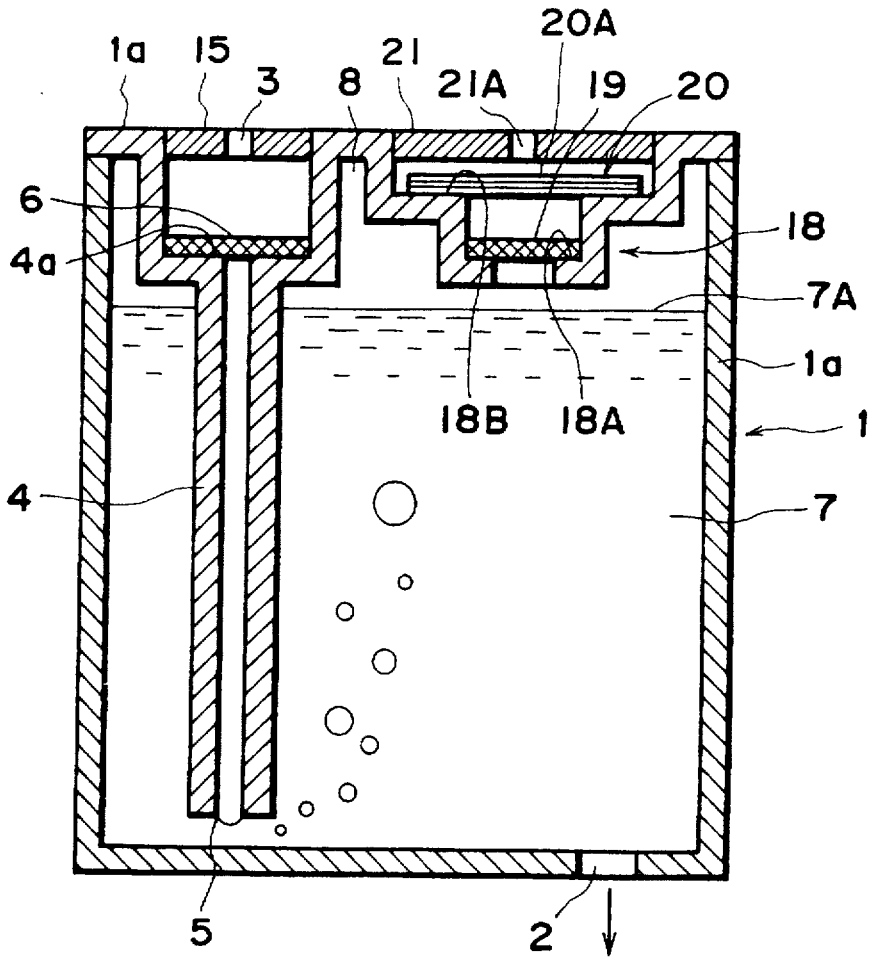
FIG. 13 is a schematic sectional view of the ink container illustrated in FIG. 11, depicting the negatively pressurized state thereof

FIG. 11 is an external perspective view of the third embodiment of the present invention, and FIGS. 12 and 13 are sectional views thereof.

An ink container 1 comprises a main body 1*a* and a cover 1*b* which covers the top portion of the main body 1*a*. The main body 1*a* is provided with an ink supplying hole 2, which is disposed at the bottom portion of the ink container, as a connecting portion for the recording head portion.

The cover 1*b* has a tubular hollow portion 4 with a stepped portion 4*a* formed integrally therewith, wherein the tubular hollow portion 4 extends downward, with its bottom end opening being disposed near the bottom wall of the ink container main body 1*a*. At the top end of this tubular portion 4, a small lid 15 with an air vent hole 3 is fitted, and the small lid 15 has an air vent hole 3 disposed at the center thereof. In the stepped portion 4*a*, an air permeable film 6 is disposed, at least the liquid facing surface of which is made of water repellent material.

A reference numeral 7 designates liquid ink stored in the ink container 1, and its highest level is designated with an alphanumeric reference 7A.

The cover 1*b* further has a cylindrical valve holder 18 with a first and a second stepped portions 18A and 18B formed integrally therewith. In the first stepped portion 18A, an air permeable film 19, which is the same as the aforementioned air permeable film 6, is disposed, and in the second stepped portion 18B, a valve body 20A constituting a one-way valve 20 (which permits only the outward air discharge from within the ink container 1, and will be described later) is disposed. At the top end of the valve holder 18, a small lid 21 is fitted, which has an air discharge hole 21A disposed in the middle thereof.

It should be noted here that in the structure described above, the stepped portion 4*a* and first stepped portion 18A are disposed so that the air permeable films 6 and 19 are both positioned above the highest ink level 7A.

Thus, an air layer 8 can be formed between the cover 1*b* and the highest liquid level 7A, and this air layer 8 can be normally sealed from the atmospheric air.

According to the above structure, as the ink 7 within the ink container 1 is consumed through the ink supplying hole 2, the air intermittently enters the ink container 1 through the tubular portion 4 as shown in FIG. 13. At this time, the ink container 1 generates a negative pressure force directed to pull the ink 7 inward of the ink container 1 from the ink supplying hole 2, and subsequently, from the ink ejecting orifice of the recording head portion RH, due to the pressure reduction caused in the air layer 8 by the ink consumption and the force of the meniscus formed at the opening 5. Therefore, a proper amount of negative pressure is provided at the recording head portion RH. As a result, the ink is stably supplied to offer a preferable print quality.

Further, even after the ink consumption is interrupted, this negative pressure force remains, and prevents the ink from leaking out of the ejection orifice of the recording head portion RH.

As for the air permeable film 6, it is provided to prevent the ink 7 from leaking out of the air vent hole 3 due to the vibration or the like that occurs during the transportation of the ink container 1.

An experiment was conducted by the inventors to measure the negative pressure force. The ink used therefor was composed of:

| | |
|---|---|
| Glycerine | 5.0% |
| Thiodiglycol | 5.0% |
| Urea | 5.0% |
| Isopropanol | 4.0% |
| $H_2O$ | 78.0% |
| Dye | 3.0% |

and its surface tension was 50 dyne/cm. The ink container had a tubular portion 14 of polypropylene, and had an internal diameter of 0.38 mm. The negative pressure force thus obtained was approximately −45 mmAg at the supply hole 2 of the ink container 1. The negative pressure force obtained when this system and different inks (1)–(3) with different compositions that were used are given in Table 2.

TABLE 2

| | Ink (1) | Ink (2) | Ink (3) |
|---|---|---|---|
| Surface tension (dyne/cm) | 30 | 40 | 48 |
| Negative pressure during printing (mmAg) | −33 | −38 | −48 |
| Retained negative pressure in static state (mmAg) | −25 | −32 | −42 |

When the different inks are used, the same degree of negative pressure force can be obtained by changing the internal diameter and/or material of the tubular portion 4.

Figure 7:
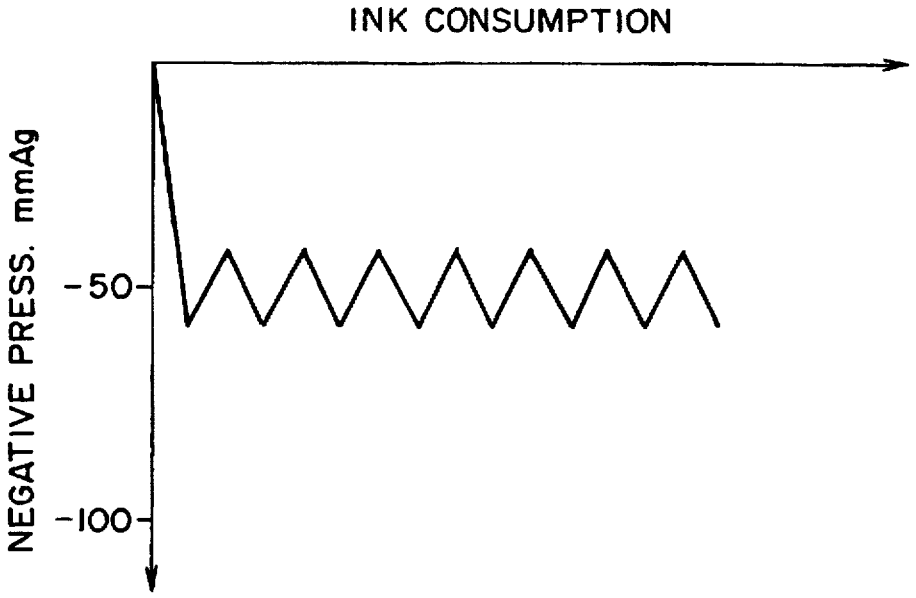
FIG. 7 is a graph of the relationship between the negative pressure force generated by the ink container in accordance with the present invention, and the ink consumption thereof.

According to experiments, the negative pressure force was not dependent on the level of the ink 7, displaying substantially flat values from the beginning of the ink consumption till right before the ink depletion (FIG. 7). In other words, substantially stable print quality can be provided from the beginning of the ink consumption right up to the point of ink depletion.

As for the air permeable film 6, its material is polytetrafluoroethylene, wherein this material is stretched to create numerous microscopic pores therein, and then, is subjected to the oil repelling treatment. The diameter of the microscopic pore is 0.1–0.3 μm.

Further, the ink container 1 comprises an air discharging hole 21A, a one-way valve 20, and an air permeable film 19. Since this one-way valve 20 is formed so as to allow the internal air to be moved in the direction of only an arrow mark A in the drawing, that is, only to be discharged out of the ink container 1, and is normally closed; therefore, it does not affect the negative pressure force generated by the ink consumption.

Here, referring to FIGS. 14 and 15, the details of the one-way valve 20 will be described.

Figure 14:
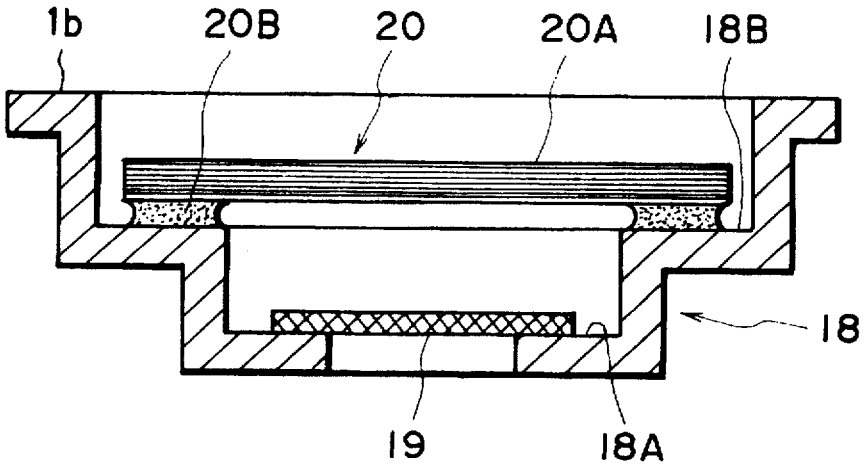
FIG. 14 is a partially enlarged sectional view of the ink container illustrated in FIG. 11, in which the one-way valve is closed.
Figure 15:
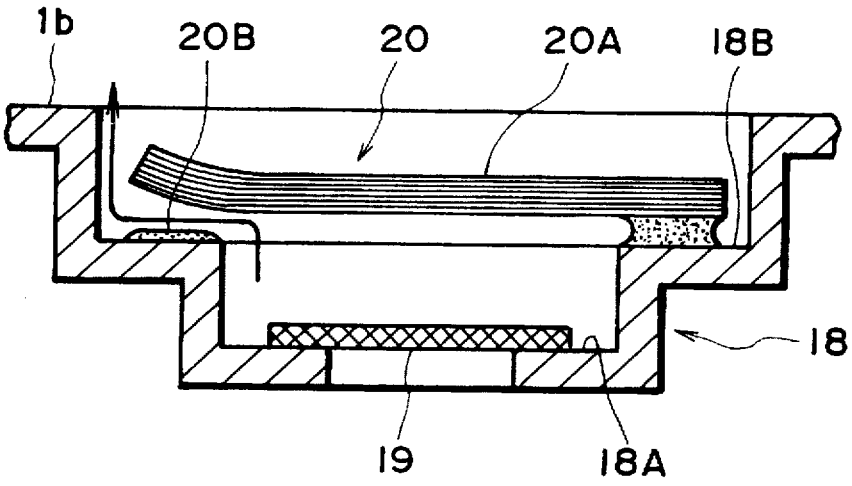
FIG. 15 is a partially enlarged sectional view of the ink container illustrated in FIG. 11, in which the one-way valve is open.

FIG. 14 is a sectional view of an embodiment of the one-way valve 20.

In the cylindrical valve holder 18 integral with the cover **1*b* of the ink container 1, the first and second stepped portions 18A and 18B are provided. The air permeable film 19 is disposed within the first stepped portion 18A. In the second stepped portion 18B, the valve body 20A constituted of a thin film is disposed, wherein an adhesive sealant 20B such as silicon oil is placed between the second stepped portion constituting a valve seat (hereinafter, valve seat) 18B and the thin film constituting the valve body 20A, sealing thereby the two. When substantially no pressure difference exists, the adhesive sealant 20B** seals between the two components, with its adhesiveness. As for the adhesive sealant, it is preferable to employ liquid material such as silicon oil, which is not volatile, and has an approximate viscosity range of 50–500 cst.

Next, the operation of this valve will be described. As the internal pressure of the ink container 1 increases relative to the external pressure, the valve body 20A of thin film is pushed out in the upward direction of the ink container 1. More specifically, as the difference between the internal and external pressure of the ink container 1 reaches a predetermined one, the adhesive sealant 20B is partially separated from the valve seat 18B, allowing thereby an air passage to be formed as shown in FIG. 15. As the pressure difference is moderated through this partial separation, the air passage is quickly sealed due to the elasticity of the valve body of the thin film and the surface tension of the adhesive sealant 20B. As for the valve body 20A of the thin film, when a round valve body of 25–100 μm thick polyethylene terephthalate (PET) film with a diameter of 13 mm was used, preferable results were obtained.

Next, referring to FIGS. 16 and 17, another embodiment of the aforementioned one-way valve 20 will be described. In these drawings, in order to avoid repetition of the same descriptions, the portions having the same functions as the those in the preceding embodiments are given the same referential symbols.

Figure 16:
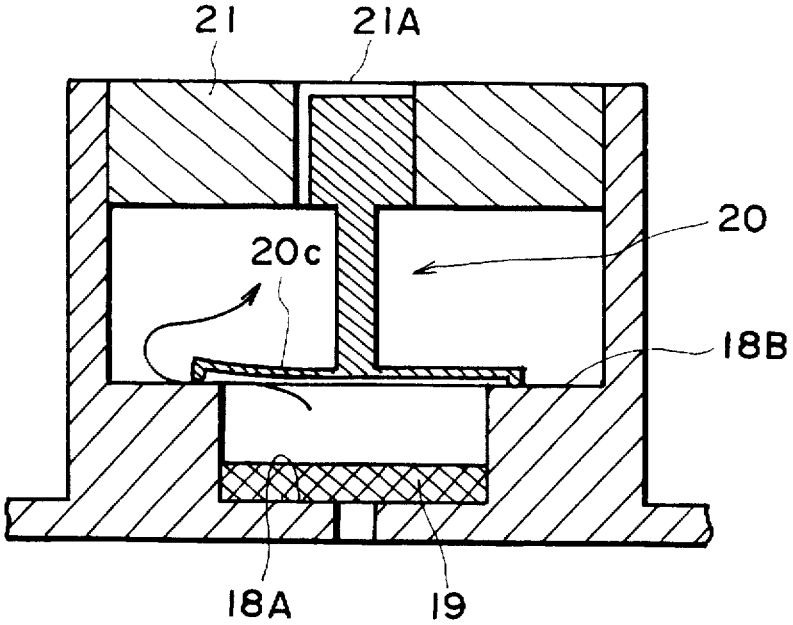
FIG. 16 is a partially enlarged sectional view of a different structure of the one-way valve.

FIG. 16 is a sectional view of another embodiment of the one-way valve 20.

A valve body 20C of this embodiment is shaped like a mushroom, and is made of elastic material such as chlorinated butyl rubber. When a pressure difference occurs between the internal pressure of the ink container 1 and atmospheric pressure, the valve body **20*c* deforms and its adhesion to the valve seat 18*b*** is partially broken, allowing thereby an air passage to be formed. As a result, the air within the ink container is discharged.

Figure 17:
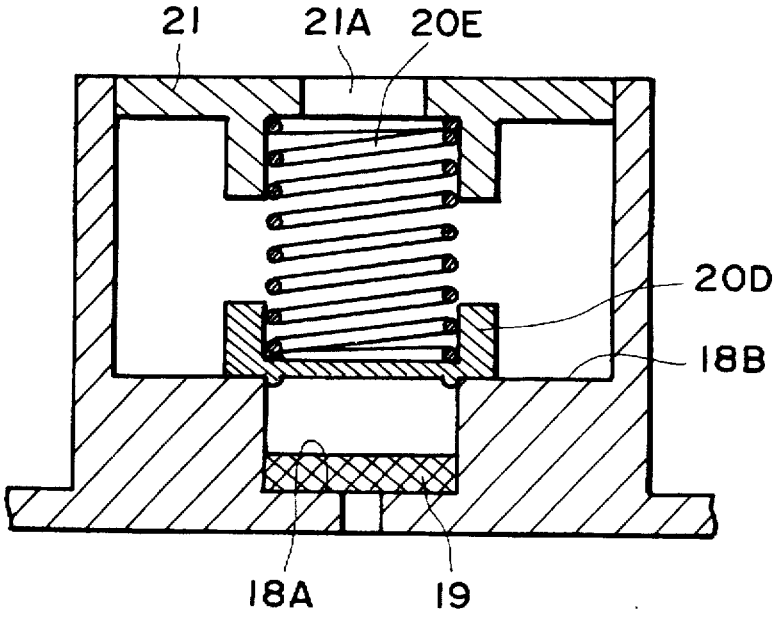
FIG. 17 is a partially enlarged sectional view of another structure of the one-way valve.

FIG. 17 is a sectional view of another embodiment of the one-way valve 20.

The valve body 20D is made of material capable of making airtight contact with the valve seat 18B, and is pressed by a spring member 20E in the direction of making contact with the valve seat 18B. As the pressure difference occurs between the internal air of the ink container 1 and the atmosphere, the spring member 20E deforms and allows the airtight contact between the valve seat 18E and valve body 20D to break. As a result, an air passage is formed to let the internal air of the ink container 1 be discharged.

In either of the above two embodiments of the one-way valve, the air permeable film 19, the surface of which facing the ink liquid is made of the water repellent material, is disposed to allow only the air to be discharged through an air discharging hole 21A. This arrangement is the same as the one described in the preceding embodiment.

In the preceding Embodiments 1, 2 and 3, the internal negative pressure of the ink container 1 is adjusted to be in a predetermined range by consuming (discharging) the ink through the recording head; therefore, the ink is wasted. However, the embodiments given below are provided with not only the structure that generates the negative pressure by discharging the ink from the recording head, but also, an additional structure that generates the negative pressure without discharging wastefully the ink.

(Embodiment 4)

Next, referring to FIGS. 18 and 19, the fourth embodiment will be described in detail, in which the negative pressure force is generated by decreasing the pressure of the air layer 8 within the ink container 1.

Figure 18:
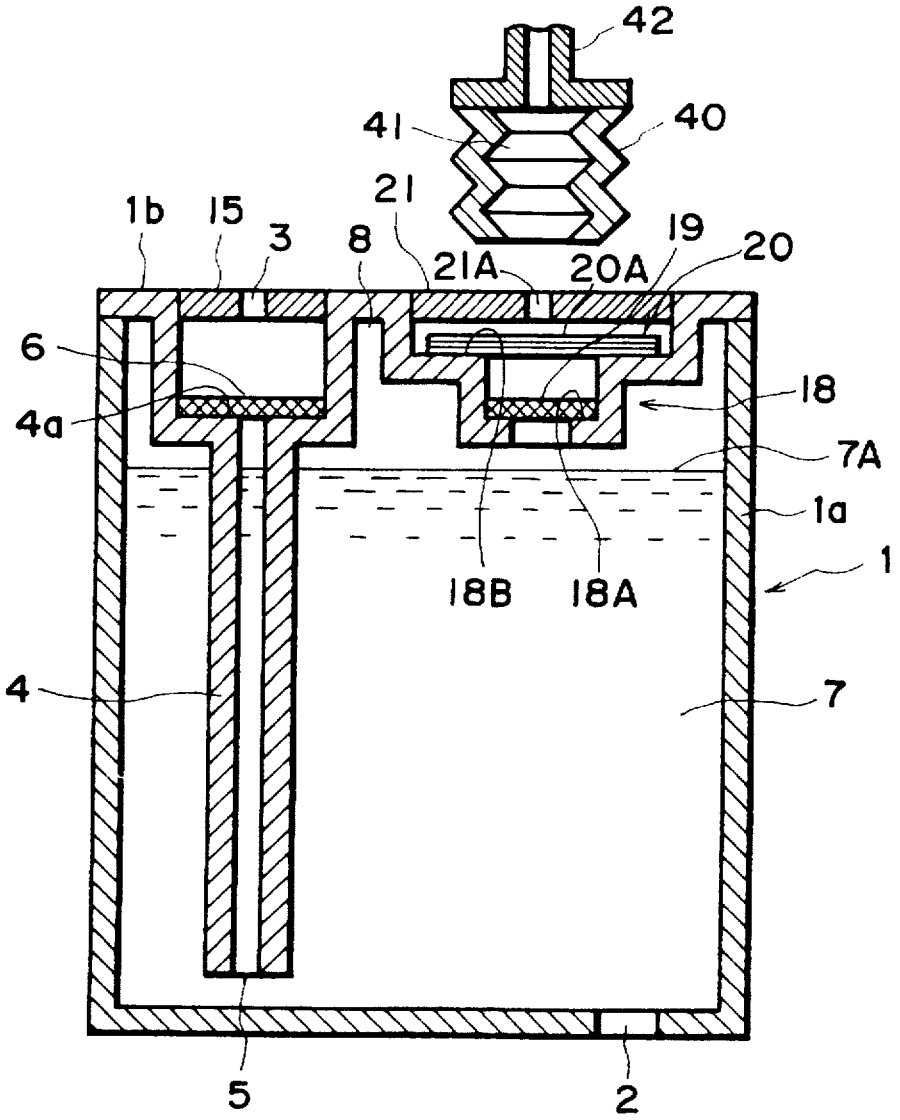
FIG. 18 is a schematic sectional view depicting the relationship between the ink container illustrated in FIG. 11, and sucking means.

FIG. 18 depicts an ink container 1 in a state immediately after its installation into an ink jet recording apparatus after the transportation. A reference numeral 40 designates a cap connected through a connecting tube 42 to the suction pump of the ink jet recording apparatus, which will be described later. The cap 40 is constituted of a member capable of making airtight contact with the ink container 1, and thereby, capable of sealing the internal space 41 thereof.

Figure 19:
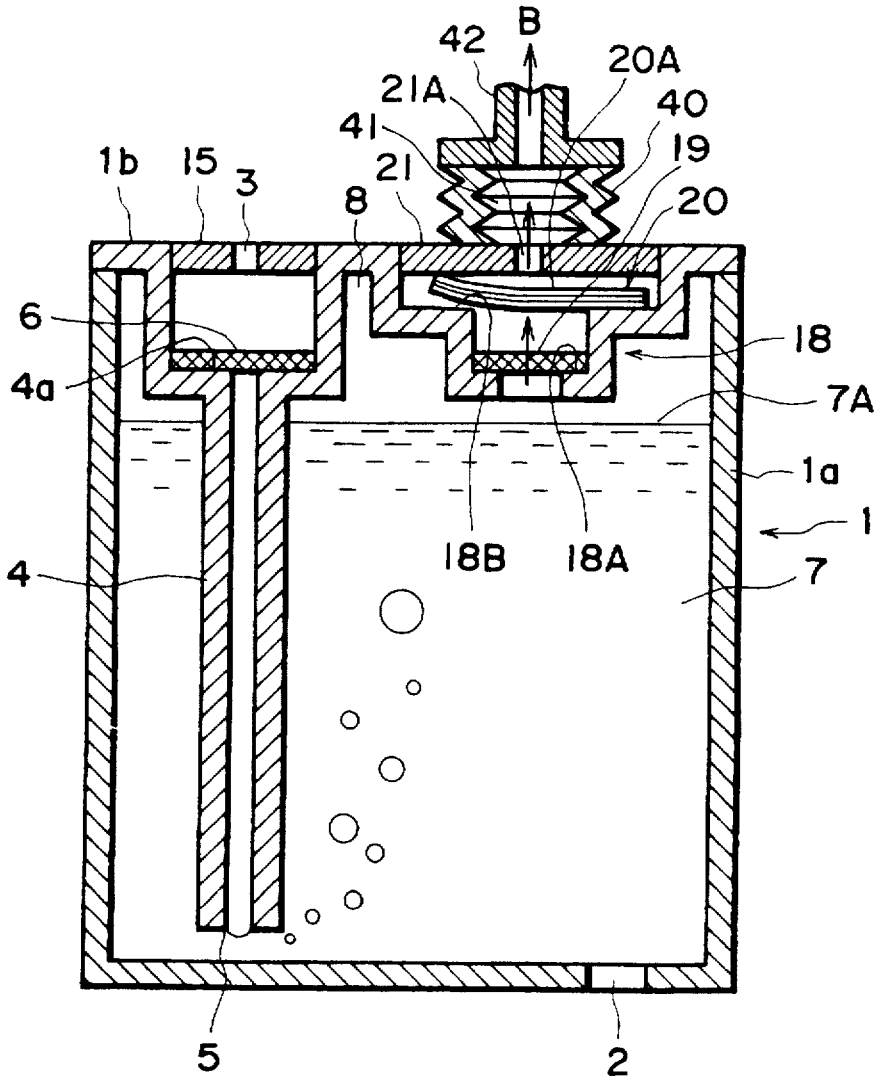
FIG. 19 is a schematic sectional view depicting a state in which the sucking means is acting on the ink container.

After the installation of the ink container 1, the cap 40 is placed airtightly in contact with the ink container 1 as shown in FIG. 19, and the suction pump of the ink jet recording apparatus is activated. Then, the air within the space 41 is sucked in the direction of an arrow mark B, reducing the air pressure within the space 41 below the atmospheric pressure. As the internal pressure of the space 41 is reduced to a predetermined value, a one-way valve 20 opens, and subsequently, the air is sucked out of the air layer 8 within the ink container 1. As the pressure of the air layer 8 drops below the atmospheric pressure, the liquid ink level within the tubular portion 4 drops, maintaining a certain amount of the negative pressure, till a meniscus is formed at the opening 5. At this moment, the pump is stopped and the cap 40 is separated from the ink container 1. Then, the one-way valve 20 quickly closes; therefore, the reduced pressure of the air layer 8 within the ink container 1 is maintained to generate the negative pressure force at the recording head portion RH.

Figure 20:
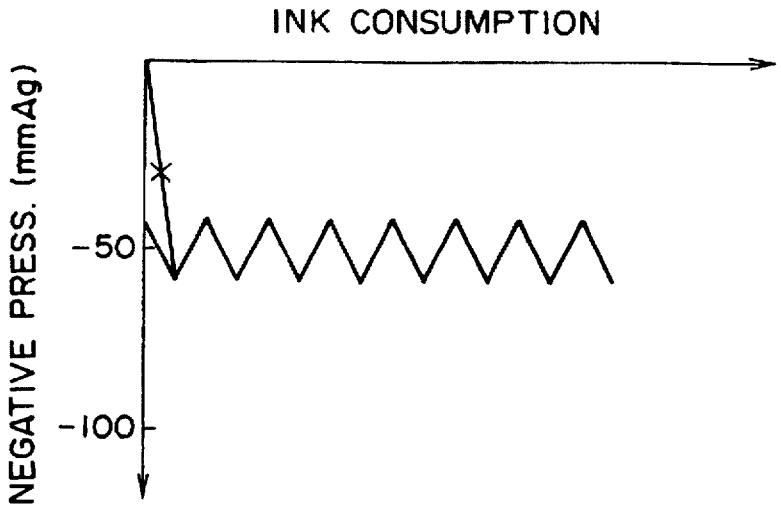
FIG. 20 is a graph of the relationship between the negative pressure and ink consumption when the sucking means illustrated in FIGS. 18 and 19 is used.

The negative pressure force generated in this manner is maintained during the following printing operation and after the completion of the printing operation. However, when the ink container is left without being operated for a long period of time, the negative pressure of the air layer 8 sometimes changes due to the ink 7 evaporation or the like. In consideration of such a predicament, the aforementioned sucking operation may be carried out not only at the time of the ink container installation, but also, every so often with predetermined intervals or at the beginning of every printing operation . In case of this sucking operation, the negative pressure is adjusted to a predetermined level from the beginning of the ink consumption without consuming the ink, as shown in FIG. 20; therefore, no matter how many times this operation is repeated till the ink is depleted, no ink is going to be wasted.

(Embodiment 5)

Figure 21:
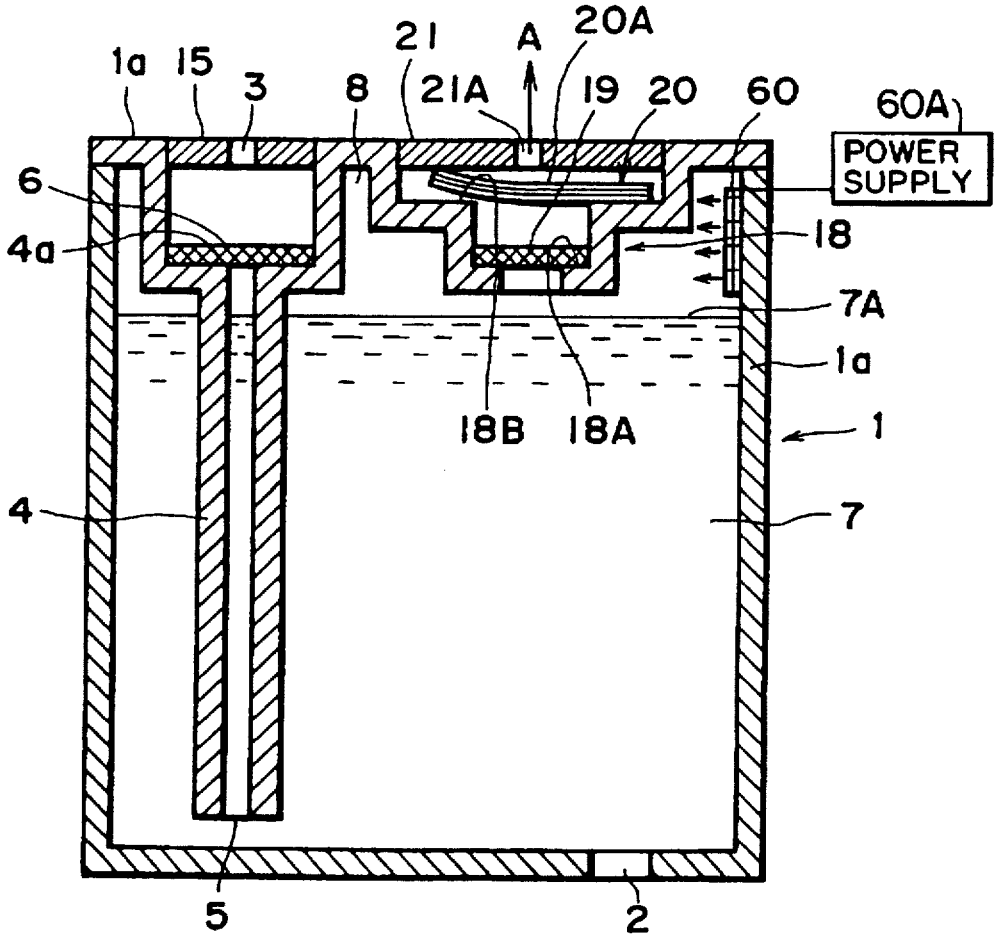
FIG. 21 is a schematic sectional view depicting the relationship between the ink container illustrated in FIG. 11 and negative pressure generating means.
Figure 22:
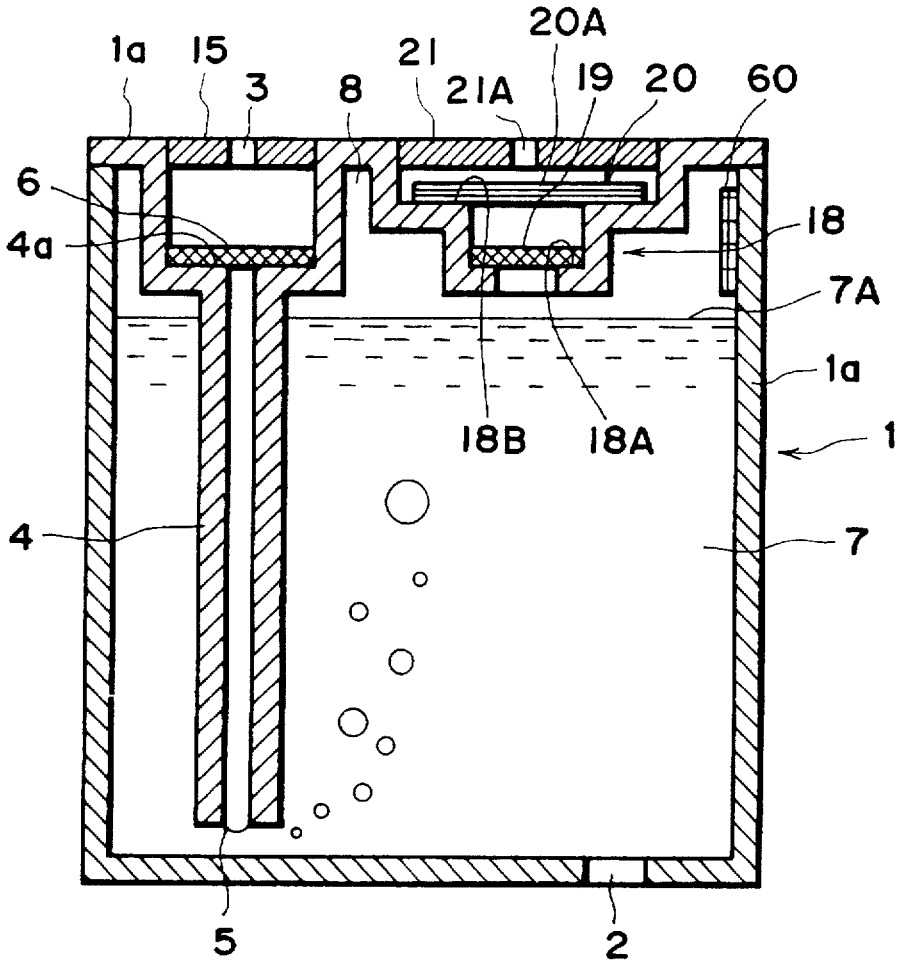
FIG. 22 is a schematic sectional view depicting a state in which the negative pressure generating means for the ink container illustrated in FIG. 21 is in action.

FIGS. 21 and 22 are sectional views of the fifth embodiment of the present invention. In the case of this embodiment, a heater as means for pressurizing the air layer is added to the structure of Embodiment 3.

A reference numeral 20 designates the same one-way valve as the one described in Embodiment 3. It opens only when the internal pressure of the ink container 1 becomes higher than the external pressure of the ink container 1. A heater 60 is disposed on the internal wall surface of the ink container 1 above the highest liquid ink level 7A, and its power supply 60A is controlled by the signal from the control section of the ink jet recording apparatus.

In this embodiment, as the ink container 1 is mounted in the ink jet recording apparatus, the heater 60 is turned on by an ON signal from the recording apparatus. As the interior of the ink container 1 is heated by the heater 60, the air of the air layer 8 expands, creating thereby a high pressure condition relative to the atmosphere. At this moment, the meniscus force at the ink ejecting orifice of the recording head portion RH is sufficiently larger than the force necessary to open the one-way valve 20 (the opening pressure of the one-way valve 20 is set to be sufficiently small); therefore, before the ink is forced to leak out of the ejection orifice, the one-way valve 20 opens to allow a portion of the air to be discharged, reducing thereby the internal pressure of the ink container to a pressure level substantially equal to the internal pressure of an open ink container and maintaining it. Next, as the heating by the heater 60 is stopped, the one-way valve 20 closes as illustrated in FIG. 22. Thereafter, the air layer 8 within the ink container 1 gradually cools down and contracts. As a result, the pressure of the air layer 8 becomes lower than the atmospheric pressure. As the pressure of the air layer 8 drops further, the air enters the ink container 1 through the tubular portion 4, whereby a meniscus is formed at the opening 5, with the air layer 8 maintaining a predetermined negative pressure value.

This state of the negative pressure created in the air layer 8 at this time and the negative pressure force thereof are maintained during the following printing operation and thereafter. However, when the ink container is left without being used for a printing operation for a long time, the reduced pressure state of the air layer 8 may sometimes change due to the ink evaporation or the like. In consideration of such a predicament, this heating operation may be performed not only at the time of the ink container installation, but also, every so often with predetermined intervals using a timer, or every time at the beginning of the printing operation. This heating operation does not require a mechanical operation; therefore, the structure is simple. Also, it does not involve ink consumption; therefore, no matter how many times it is repeated before the ink depletion, no ink is wasted.

Figure 27:
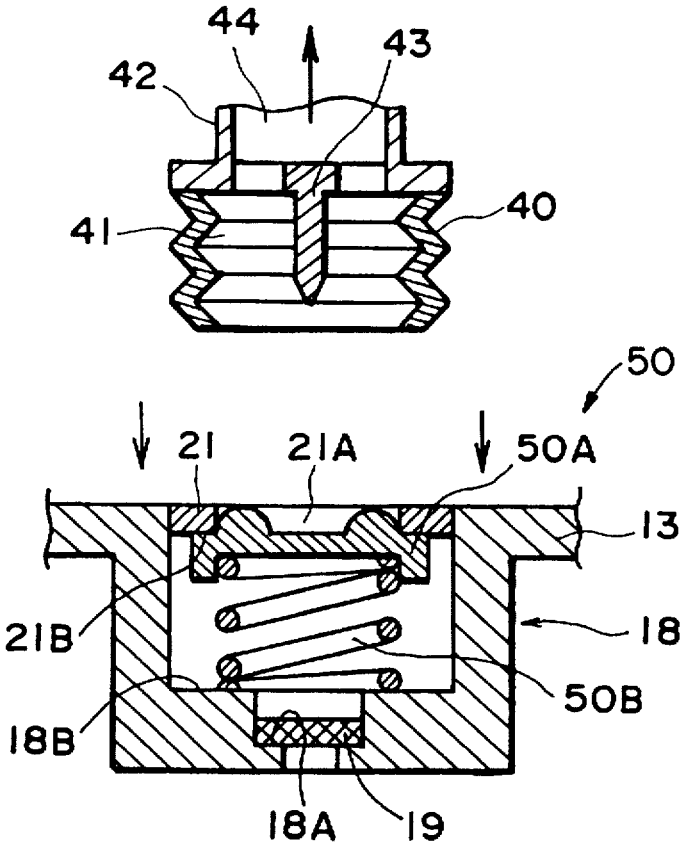
FIG. 27 is an enlarged sectional view of another structure of the negative pressure generating means.

Further, in this embodiment, the one-way valve 20 is employed, but instead a valve 50 such as the one shown in FIG. 27 may be employed, wherein while the heater is activated, the air discharge opening 21A is unblocked using the opening-closing member connected to the ink jet recording apparatus.

On the other hand, it is needless to say that the same effects as those obtained by heating the interior of the ink container 1 with the internal heater 60 can also be obtained by using such a structure that the entire ink container is externally heated.

(Embodiment 6)

Figure 23:
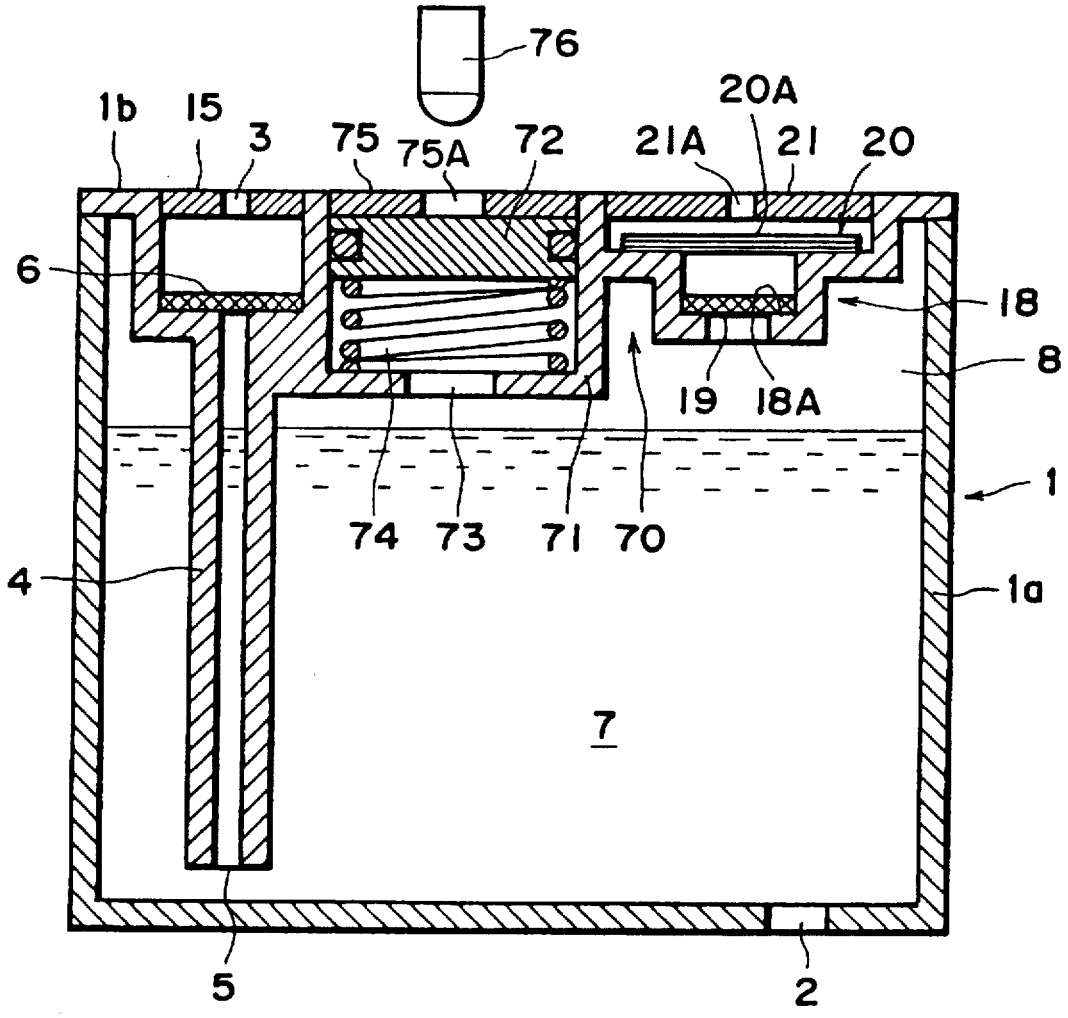
FIG. 23 is a schematic sectional view depicting the relation between the ink container illustrated in FIG. 11 and different negative pressure generating means.
Figure 24:
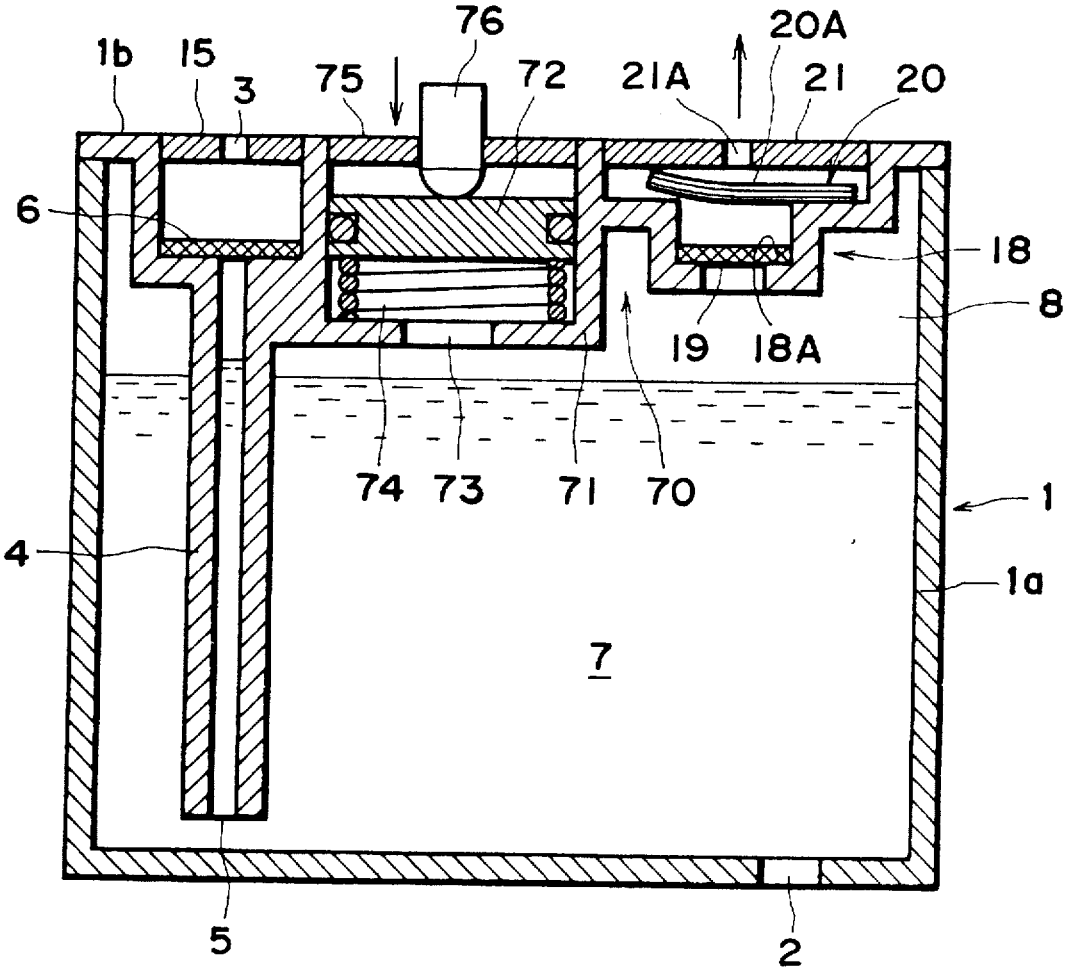
FIG. 24 is a schematic sectional view depicting a state in which a different negative pressure generating means for the ink container illustrated in FIG. 23 is in action.
Figure 25:
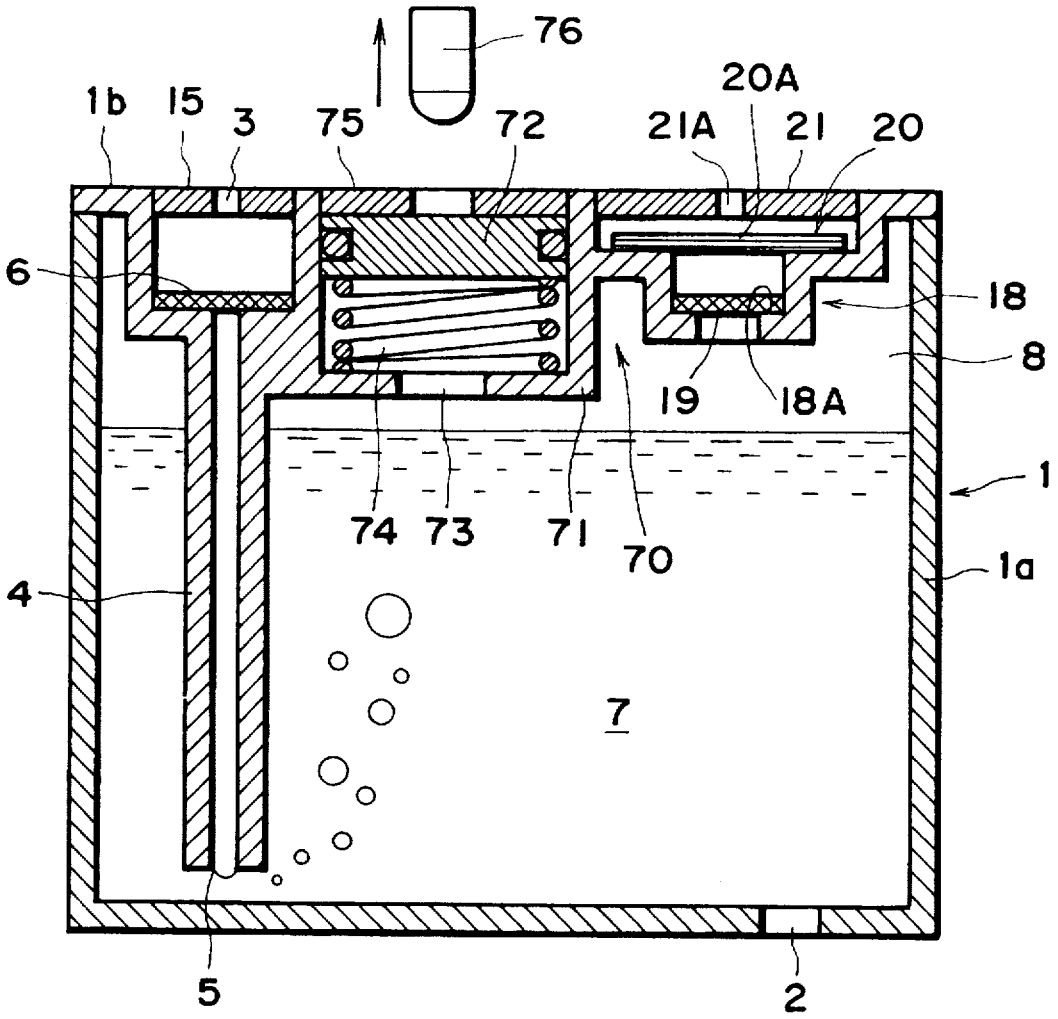
FIG. 25 is a schematic sectional view depicting a state in which another negative pressure generating means for the ink container illustrated in FIG. 23 is in action.

FIGS. 23, 24 and 25 are sectional view of the sixth embodiment of the present invention.

A reference numeral 20 in the drawing designates the same one-way valve as the one described in Embodiment 3. It opens only when the internal pressure of the ink container becomes higher than the pressure outside the ink container. A reference numeral 70 designates a pump as pressurizing means, comprising a cylinder 71 integral with the cover 1*b* and a piston 72 fitted therein so as to slide freely. The piston 72 is made of elastic material, such as rubber, which is capable of making airtight contact. Since the piston 72 is airtightly in contact with the internal peripheral surface of the cylinder 71 without any gap, no air passes between the cylinder 71 and piston 72. The bottom portion of the cylinder 71 is in communication with the air layer 8 through an ejection opening 73 of the pump, and the piston 72 is pressed by a spring member toward a small lid 75 fitted at the end of the cylinder 71, so as to maximize the internal volume of the ink container 1. Further, an insert hole 75A, in which a pressing member 76 is inserted, is provided at the center of the small lid 75.

In this embodiment, as the ink container 1 is installed into the ink jet recording apparatus, the pressing member 76 provided on the ink jet recording apparatus pushes down the piston 72 in the direction of reducing the internal volume of the ink container 1 (FIG. 24).

At this time, the pressure of the air layer 8 in the ink container 1 becomes higher than the atmospheric pressure, and as a result, the one-way valve 20 is opened. The meniscus force at the ink ejecting orifice of the recording head portion RH is sufficiently larger than the pressure needed to open the one-way valve 20 (opening pressure of the one-way valve 20 is set to be sufficiently small); therefore, before the ink is forced to leak from the ejection orifice, the one-way valve 20 opens to change the internal pressure of the ink container 1 to a pressure equivalent to that of an open container.

Next, as the pressure from the pressing member 76 is removed, the piston 72 is moved by the resiliency of the spring member 74 in the direction of maximizing the internal volume of the ink container 1 (FIG. 25). At this moment, the one-way valve 20 does not allow the air to enter the ink container 1, and at the same time, the meniscus force at the ejection orifice of the recording head portion RH is sufficiently large; therefore, as the piston 72 returns in the direction of maximizing the internal volume of the ink container, the air is taken into the air layer 8 from the opening 5 of the tubular portion 4, and when the negative pressure of the air layer 8 reaches a predetermined negative pressure level, the air stops flowing in through the opening 5.

In this case, it is preferable that the volume that the piston 72 pushes, that is, the product of the stroke and area of the piston 72, is sufficiently larger than the volume of the passage within the tubular portion 4.

The state of the negative pressure created in the air layer 8 and the negative pressure force thereof are maintained during the following printing operation and thereafter. However, when the ink container is left without being used for the printing operation for a long time, the reduced pressure state of the air layer 8 may sometimes change due to the ink evaporation or the like. In consideration of such a predicament, this piston pushing operation may be performed not only at the time of the ink container installation, but also, every so often with predetermined intervals using a timer, or every time at the beginning of the printing operation. Further, this piston pushing operation does not involve the ink consumption; therefore, no matter how many times it is repeated before the ink depletion, no ink is wasted.

Also in this embodiment, the one-way valve 20 is employed, but the valve 50 such as the one shown in FIG. 27 may be employed, wherein when the piston 72 is pushed by an opening-closing member connected to the ink jet recording apparatus, the air discharge opening 20A is opened, and after the piston 72 is moved till the internal volume of the ink container 1 is minimized, the valve 50 is closed.

On the other hand, an elastic member such as a rubber pouch may be employed in place of the piston. It is needless to say that the same effects can be obtained with provision of such a mechanism that a portion of the ink container main body is pressed from outside.

In this embodiment, in place of the aforementioned one-way valve 20, a valve 50 is provided, which is pressed outward from inside the ink container to seal the air layer 8, and the rest of the structure is the same as the preceding embodiment.

More specifically, in this embodiment, a cylindrical valve holder 18 with stepped portions 18A and 18B is integrally formed with the cover **1*b* as it is in the preceding embodiment. At the top end thereof, a small lid 21 is fitted, which has an air discharge hole 21A at the center. A valve body 50A is pressed outward from inside the ink container by a spring member 50B so as to be placed airtightly in contact with the periphery portion (hereinafter, valve seat) of the air discharge hole 21A. In order to prevent the air from entering through the air discharge hole 21A and affecting the negative pressure force during a printing operation, the pressing force of the spring member 50B is set up to maintain the airtight contact between the valve body 50A and valve seat 21B** during the printing operation.

The valve body 50A is made of material capable of providing the airtight contact between the valve body 50A and valve seat 21B.

Next, a method for initially generating the negative pressure force by reducing the pressure of the air layer 8 within the ink container 1 at the time of the ink container installation or the like will be described more specifically.

A reference numeral 40 in the drawing designates a cap connected to the suction pump of an ink jet recording apparatus. The cap 40 is constituted of a member capable of making airtight contact with the ink container 1 as described before. In this embodiment, an opening-closing member 43 is supported within a connecting tube 42 with a supporting arm 44, and its movement during the ink container installation is linked to the movement of the cap 40, and pushes the valve body 50A to enable the air to flow through the air discharge hole 21A.

After the ink container is mounted in the ink container 1, the cap 40 is placed airtightly in contact with the ink container 1, and at the same time, the valve body 50A is pressed with the opening-closing member 43 to unblock the air discharge opening 21A. In this state, the suction pump of the ink jet recording apparatus is activated to reduce the pressure of the air layer 8 within the ink container 1 below the atmospheric pressure. As the pressure of the air layer 8 becomes lower than the atmospheric pressure, the ink level within the tubular portion 4 drops as describe before, and this drop is allowed till a meniscus is formed at the opening 5, maintaining still a certain degree of the negative pressure. At this moment, the opening-closing member 43 is moved in the direction to remove the pressure applied on the valve body 50A. Then, the valve body 50A blocks the air discharge hole 21A due to the resiliency of the spring member 50B, with the cap 40 remaining still airtightly in contact with the ink container 1, and thereby, maintaining the reduced pressure of the air layer. Next, the pump operation is stopped, and the cap 40 is separated from the ink container 1.

Figure 26:
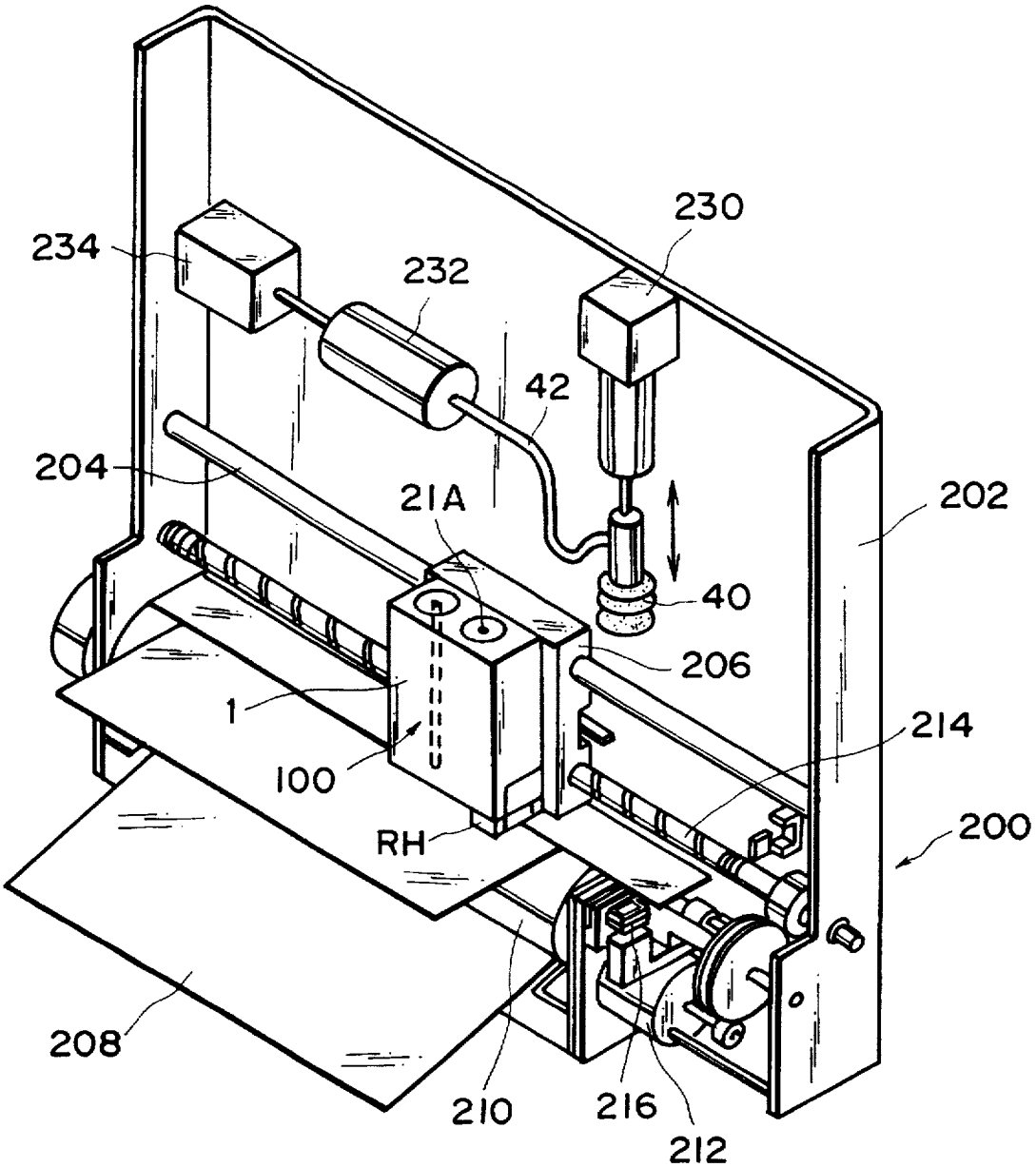
FIG. 26 is a perspective view of an exemplary recording apparatus, in which an ink container according to the present invention is installable, and in which an exemplary negative pressure generating means is disposed.

Next, referring to FIG. 26, an example of the ink jet recording apparatus 200, in which an ink jet recording head cartridge 100 constituted of a combination of the ink container 1 in accordance with one of the aforementioned embodiments of the present invention and the ink jet recording head RH is mounted, will be described.

This ink jet recording apparatus 200 comprises a carriage 206, which is reciprocally guided by a guide rod 204 mounted horizontally on a frame 202 having a U-shaped section, and the ink jet recording head cartridge 100 is mounted on this carriage 206, with its ejection surface, on which the ejection orifices are arranged, facing downward. The ink jet recording apparatus 200 further comprises: a motor 212 as a driving power source for driving a conveyer roller 210 or the like that conveys a recording medium 208; a spirally grooved carriage shaft 214 for transmitting the power from the power source to the carriage 206; well-known signal supplying means (unillustrated) that supplies the ink jet recording head RH with control signals for triggering the ink ejection; and the like.

Further, at the home position of the carriage 206, a cap 216 made of rubber material or the like is disposed. When the carriage is at the home position, the cap 216 covers the entire ejection surface of the recording head RH to prevent the ink from solidifying (drying) at the ejection orifice, that is, the very location from which the ink is ejected. Further, the cap 216 is connected to an unillustrated pump, which is used to clean the ejection orifice before the printing operation is started. More specifically, it is used to suck the high viscosity ink or the like, that is, the ink or the like, the viscosity of which has increased through an extended non-usage period of the recording head cartridge, out of the ejection orifice. Further, in the top portion of the frame 202, a motor 230 is disposed, which vertically drives the aforementioned cap 40, which is to be placed in contact with the top surface of the ink container 1, that is, in communication with the air discharge hole 21A of the ink container 1.

As described above, the cap 40 is connected to a piston pump 232 as the suction pump through a connecting tube 42. As the piston pump 232 is driven by a motor 234, and thereby, the internal cylinder volume is changed, the air within the ink container 1 is sucked through the cap 40.

In this embodiment, the present invention has been described with reference to the piston type pump, but the present invention is not limited to the piston type pump, and it is needless to say that a different type of pump may be employed.

When a valve holder 18 with a structure illustrated in FIG. 27 is employed in the ink container 1 of Embodiment 4, all that is necessary is to employ a cap 40 in which the opening-closing member 43 is disposed, and in the case of an ink container 1 comprising the pump of Embodiment 6 illustrated in FIG. 23, all that is needed is to place a motor (unillustrated) for driving vertically the pressing member 76, next to the motor 230 for the cap 40.

According to the present invention, foamed material such as the foamed urethane resin is not contained as it is according to the prior art; therefore, the problematic unsatisfactory usage efficiency and dissolution of the foamed material into the ink can be eliminated. As a result, the amount of the usable ink increases, and also, such a problem that the negative pressure force varies between the beginning of the ink consumption and the ink depletion is solved.

In any of the ink container structures according to Embodiments 1–6 of the present invention, the air intermittently enters the ink container in response to the consumption of the ink within the ink container. At this time, due to the pressure reduction occurring within the air pocket formed by the air flowing into the ink container in response to the ink consumption, and also, due to the force of the meniscus of the air at the opening, the ink container generates a negative pressure force directed so as to pull the ink inward of the ink container at the ink supplying portion or the ink ejecting orifice of the recording head. As a result, a proper amount of the negative force is provided in the recording head.

Thus, the present invention can provide an ink container which is capable of not only supplying stably the ink, but also, offering the preferable print quality.

Further, the present invention can provide an ink container in which this negative pressure force remains to prevent the ink leaking out of the recording head portion even after the ink consumption is interrupted.

Further, the present invention can provide an ink container in which the air permeable film prevents the ink from spilling out of the air vent due to the vibration or the like that occurs during the transportation of the ink container.

Further, according to the present invention, means is provided for moderating the internal pressure increase, in order to deal satisfactorily with the increase or decrease of the air pocket volume, which is triggered by the environmental changes; therefore, the internal pressure of the ink container is prevented from becoming positive relative to the atmospheric pressure, whereby the preferable negative pressure can be maintained.

Further, the employment of the structure described in Embodiments 4–6 of the present invention can offer extremely beneficial effects. That is, the preferable print can be highly reliably obtained while eliminating the wasteful ink usage such that the ink must be extracted till a preferable negative pressure force is generated within the ink container.

While the invention has been described with reference to the structures disclosed herein, it is not confined to the details set forth and this application is intended to cover such modifications or changes as may come within the purposes of the improvements or the scope of the following claims.

What is claimed is:

1. A liquid container detachably mountable relative to an ink jet recording apparatus having sucking means for removing air, said container having an interior for containing liquid at a predetermined level for recording, said container having a lower portion including a liquid outlet for fluid communication with a recording head and having an upper portion with a layer of air formed therein, said container comprising:

a fine hollow tube having one end in fluid communication with ambient through an air vent provided above the level of the liquid in said interior of said liquid container; and a one-way valve, disposed in said upper portion, which permits only discharge of air from the layer of air to the ambient, wherein the air is discharged through said one-way valve by said sucking means of said recording apparatus.

2. A container according to claim 1, further comprising an air permeable film disposed at said air vent, said air permeable film having a surface facing the interior of said container, and said air permeable film being water repellent at least on said surface.

3. A container according to claim 1, wherein said fine hollow tube has an opening disposed adjacent to the lower portion of said container, and said opening faces downward when said container is mounted on the recording apparatus for recording.

4. A container according to claim 1, further comprising pressurizing means for pressurizing the layer of air.

5. A container according to claim 4, wherein said pressurizing means comprises a heater for heating at least the layer of air.

6. A container according to claim 4, wherein said pressurizing means comprises a pump having a piston.

7. A container according to claim 1, having an exterior portion and wherein said one-way valve has a sealing member which presses outward from within said container against the exterior portion of the container when said sucking means sucks the air from the layer of air through said one-way valve, thereby sealing the layer of air with respect to the ambient.

8. An ink jet recording apparatus comprising:

a recording head;

a detachable ink container having an interior for containing ink at a predetermined level for recording, said ink container having a lower portion including an ink outlet for fluid communication with said recording head and having an upper portion with a layer of air formed therein, said ink container including a fine hollow tube having one end in fluid communication with ambient through an air vent provided above said level of the ink in said ink container and a one-way valve which permits only discharge of air from the layer of air to the ambient; and sucking means for sucking air from the layer of air in said container.

9. An ink jet recording apparatus according to claim 8, wherein said sucking means sucks the air from the layer of air through said one-way valve.

10. An ink jet recording apparatus according to claim 8, wherein said ink container has an exterior portion and said one-way valve has a sealing member which presses outward from within said ink container against the exterior portion when said sucking means sucks the air from the layer of air through said one-way valve, thereby sealing the layer of air with respect to the ambient.

11. An ink jet recording apparatus according to claim 8, wherein said ink container includes a heater, disposed at said upper portion, for heating at least the layer of air, and said ink jet recording apparatus further comprises means for supplying electricity to said heater.

12. An ink jet recording apparatus according to claim 8, wherein said ink container includes a pump disposed at said upper portion, said pump having a piston, and said ink jet recording apparatus further comprises means for driving said pump.

* * * * *